US011439868B2

(12) United States Patent
Stratigos

(10) Patent No.: US 11,439,868 B2
(45) Date of Patent: Sep. 13, 2022

(54) HOLISTIC TRAINING DEVICE

(71) Applicant: Stylianos Stratigos, Nicosia (CY)

(72) Inventor: Stylianos Stratigos, Nicosia (CY)

( * ) Notice: Subject to any disclaimer, the term of this patent is extended or adjusted under 35 U.S.C. 154(b) by 0 days.

(21) Appl. No.: 17/615,231

(22) PCT Filed: Jun. 1, 2020

(86) PCT No.: PCT/GR2020/000027
§ 371 (c)(1),
(2) Date: Nov. 30, 2021

(87) PCT Pub. No.: WO2020/240216
PCT Pub. Date: Dec. 3, 2020

(65) Prior Publication Data

US 2022/0203160 A1 Jun. 30, 2022

(30) Foreign Application Priority Data

May 31, 2019 (GR) ..... 20190100240

(51) Int. Cl.
*A63B 23/035* (2006.01)
*A63B 21/00* (2006.01)
(Continued)

(52) U.S. Cl.
CPC .... *A63B 23/03575* (2013.01); *A63B 21/4033* (2015.10); *A63B 22/201* (2013.01); *A63B 23/03516* (2013.01); *A63B 2022/0043* (2013.01)

(58) Field of Classification Search
CPC ..... A63B 23/03575; A63B 23/03516; A63B 23/035; A63B 23/03533; A63B 23/03541;
(Continued)

(56) References Cited

U.S. PATENT DOCUMENTS 3,363,335 A * 1/1968 Burhns ..... A61H 1/02 601/40
3,460,272 A * 8/1969 Pellicore ..... A61H 1/02 74/615
(Continued)

FOREIGN PATENT DOCUMENTS

CN 102671345 A 9/2012
CN 103861241 A 6/2014
(Continued)

OTHER PUBLICATIONS

International Search Report and Written Opinion for PCT/GR2020/000027, dated Sep. 18, 2020.

*Primary Examiner* — Garrett K Atkinson
*Assistant Examiner* — Kathleen M Fisk

(57) ABSTRACT

Holistic training device wherein a trainee user executes a training operation of sequential cycles of a first step of synchronized contraction of left limbs and extension of right limbs, followed by a second step of reverse synchronized contraction of right limbs and extension of left limbs thereof, including a frame (10) with shorter parallel beams (1,2), longer parallel beams (3,4) and a beam (5) extending intermedially in between beams (1,2) with plate extensions (31,41) receiving freely rotatable axles (53,54) at the sides thereof. Pulleys (56*a*,57*a*-56*b*,57*b*) are fixedly mounted at the ends of the axles (53,54) and pulleys (16*a*, 17*a*-16*b*, 17*b*) are mounted proximally to the ends of beams (1,2) with straps (36*a*,36*b*-37*a*,37*b*) freely rotatabler around these pulleys, rails (33,34-43,44) being adapted to receive platforms (60) sliding thereupon, these platforms being activated through handgrip items (35*a*, 45*a*) gripped by the palms and foot hold items (35*b*, 45*b*) nesting the soles of the trainee user to implement the aforementioned sequential exercising cycles.

8 Claims, 15 Drawing Sheets

(51) Int. Cl.
*A63B 22/20* (2006.01)
*A63B 22/00* (2006.01)

(58) Field of Classification Search
CPC ... A63B 21/4033; A63B 21/15; A63B 21/151; A63B 21/154; A63B 21/4041; A63B 21/4045; A63B 22/201; A63B 22/001; A63B 22/0023; A63B 2022/0038–0043; A63B 69/0048; A63B 69/10; A63B 69/18–182; A63B 69/0022
See application file for complete search history.

(56) References Cited

U.S. PATENT DOCUMENTS 4,679,786 A * 7/1987 Rodgers ..... A63B 21/154 482/54
4,867,443 A * 9/1989 Jensen ..... A63B 69/0057 482/70
4,960,276 A * 10/1990 Feuer ..... A63B 22/203 482/4
5,224,909 A * 7/1993 Hamilton ..... A63B 23/03575 601/33
7,998,043 B2 * 8/2011 Zhou ..... A63B 22/001 482/139
9,186,551 B1 * 11/2015 Smith ..... A63B 22/203
9,265,986 B1 * 2/2016 Godak ..... A63B 23/03541
10,124,869 B1 * 11/2018 Bailey ..... B63H 16/04
11,083,967 B1 * 8/2021 Summit ..... A63F 13/285
11,305,154 B2 * 4/2022 Carruthers ..... A63B 22/0046
2012/0244998 A1 * 9/2012 Rao ..... A63B 23/03575 482/70

FOREIGN PATENT DOCUMENTS

CN 103977533 A 8/2014
CN 108143585 A 6/2018
EP 2223721 A1 9/2010
KR 1020070111782 A 11/2007
WO 2008078857 A1 7/2008
WO 2012083591 A1 6/2012
WO 2012126159 A1 9/2012

* cited by examiner

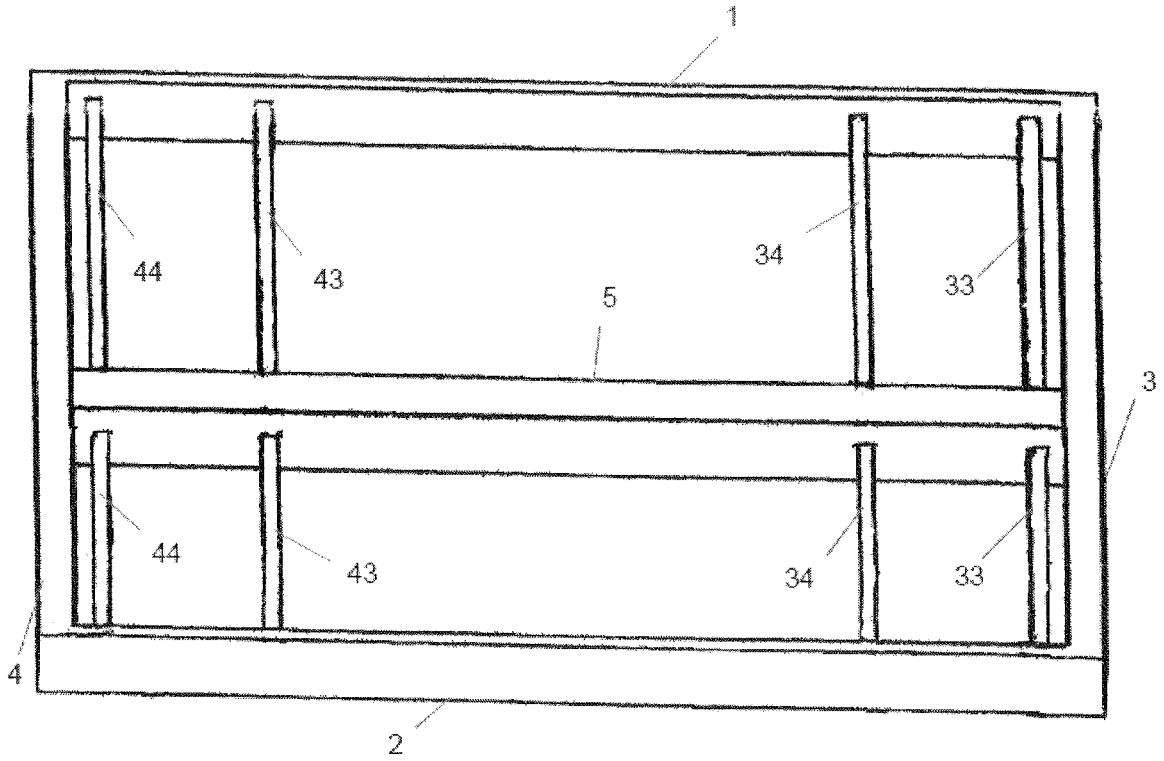
FIG. 7
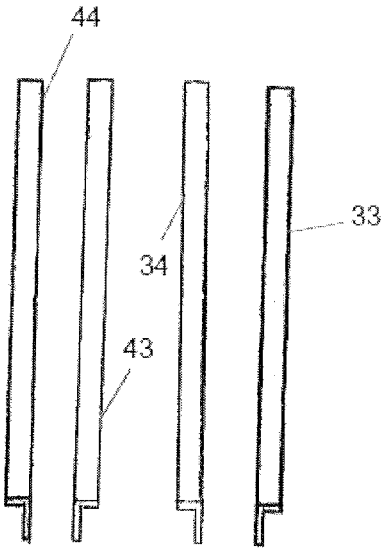
FIG. 7a
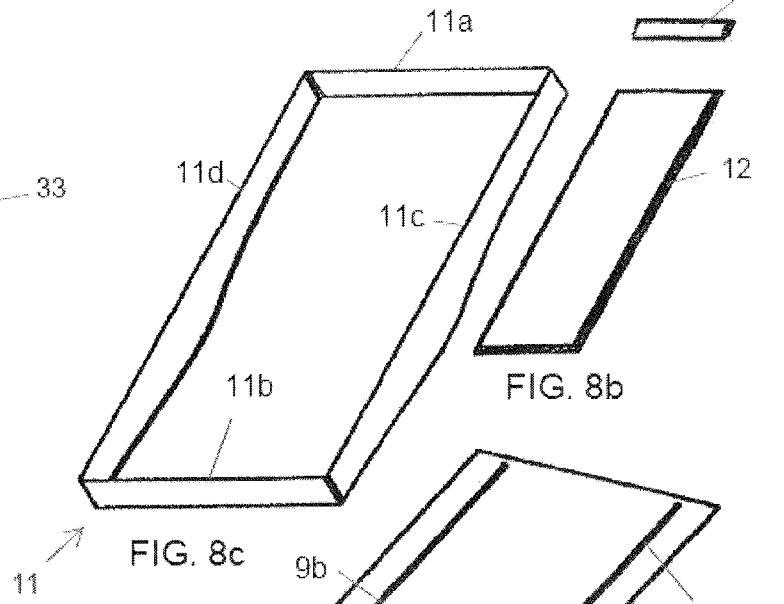
FIG. 8c
FIG. 8b
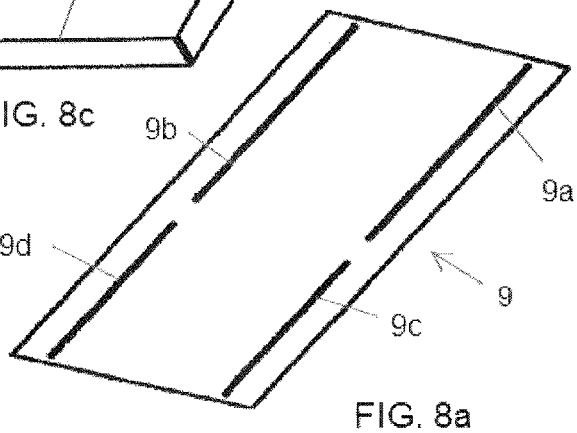
FIG. 8a 33
34
65
66
65

33
34
65
65
63
65
65

34
65
40
65
64
36a
65

66
65

HOLISTIC TRAINING DEVICE

THE FIELD OF THE ART

This invention refers to the technical field of training devices and equipment and, more specifically, it proposes a training device through which the simultaneous training of legs and arms of the trainee user is achieved, such training of arms and legs providing a full and maximum strengthening of the torso, so that, due to the achieved results, the device is characterized as a holistic training device.

BACKGROUND OF THE INVENTION

The technology of training devices and equipment, as well as training methodologies of the prior art through use of devices and equipment or even without the use of such equipment have up to today aimed at exercising particular muscle groups and, in order to achieve a holistic workout, several successive different training programs need to be performed and use of different devices and equipment is required. By way of example, different workout packages often selected by the majority of trainees relate to the exercising of arms or legs or abdominal muscles, etc.

In order to address the aforementioned unilateralism that characterizes many popular workout programs, and given the fact that there is not much free time available in the modern way of life, workout programs are developed through which the simultaneous exercise of the entire body is achieved to a certain degree. Such an exercise that aims at training the entire body is that of a horizontal movement of a trainee with the torso thereof parallel to the ground and the propulsive action of the sequential extension and contraction of left and right limbs (arms and legs), such sequential alternate extension and contraction of right and left limbs including a freely performed required bending of knees and elbows of the left and right limbs (arms and legs) thereby resulting at a forward or reverse movement of the trainee, which simulates the movement of reptiles of alligators and lizards, such movement achieving the holistic exercising of the body, and in particular, to a large extent, of the torso and of all muscle groups extending therein. In order for this exercise to be effective the torso must be maintained at a horizontal position with a slight rotation towards the side of the contracted limbs, that is, in a position that is substantially parallel to the exercising floor whereupon are being placed the palms of the hands and the soles of the feet with a scope of alternately producing simultaneous contraction of right limbs and extension of left limbs and vice versa thereby generating the propulsive movement. Such required relative parallelism is extremely difficult to be achieved, particularly by beginner trainees, who have the tendency to bend their torso as they move forwardly or rearwardly, such bending resulting at an ineffective exercising and may potentially lead to injury due to overloading of certain muscle groups. Furthermore, the effectiveness of the abovementioned exercise is also dependent on its execution in a mode that satisfies the condition of the simultaneous contraction and extension of the limbs of the trainee being performed within an equivalent period of time with an equivalent stroke of each hand and each leg thereof and this is something extremely difficult to be achieved by freely exercising trainees just by themselves and without a device that might provide an assistance in this respect. On the other hand, more advanced users, who have the capacity to perform correctly the particular exercise thereby deriving maximum expected benefits, still require an adequately amble space for moving forwardly or rearwardly, and it is obvious that such a space is not always available in an average gym or house.

The object of the present invention is to propose a device, which can address and resolve the aforementioned problems in the execution of the particular holistic training exercise through which all muscles of the human body are exercised, since they are all being used, and which results in a remarkable increase of endurance and strength, wherein the proposed device occupies a limited space that corresponds to the anticipated maximum height and breadth of the trainee user, each individual trainee user being assisted to take an appropriate face down position thereupon, according to his own body type, wherein hand palms and foot soles of the trainee are inserted within handgrips and foot holds respectively provided on both sides of the device with a frontal portion of the soles comprising the metatarsal bones being nested within a frontal portion of the foot hold, whereby a propulsive force is being exerted effecting a forward or rearward movement of the trainee during sequential cycles of a first step of synchronized contraction of left limbs and extension of right limbs followed by a second step of reverse synchronized contraction of right limbs and extension of left limbs of the trainee user of the device, such synchronized contraction and extension of the trainee's limbs being effected within an equivalent fixed timing and with equivalent strokes thereby ensuring the correctness of execution and smoothness of the exercise and eliminating the possibility of injuries that may be caused due to incorrect, unstable timing and inappropriate positioning of the body during execution of the aforementioned exercise without the device of the invention.

A further object of the invention is to propose the device with setting-options so that it can be adjusted to step-by-step upgradeable levels of difficulty, wherein such setting options may include the change in inclination of the device whereupon the trainee user performs the exercise, the adjustment of the handgrips and of the foot holds, etc.

A further object of the invention is to provide the present device with a braking mechanism that can be activated by the trainee user and with a monitor whereupon data relating to the exrcising can be displayed while the exercise is being performed, the proposed monitor providing the option to the trainee users to access the data with a scope of modifying and adapting the exercise to personal preferences.

Other objects, features and advantages of the invention shall be made clear in the following detailed description of the preferred embodiments of the proposed holistic training device.

BRIEF DESCRIPTION OF THE DRAWINGS

The invention will be fully apparent to those skilled in the art through reference to the accompanying drawings in which illustrative preferred embodiments of the holistic training device of the present invention are being shown.

FIG. 7 illustrates a planar top view of the frame provided with a pair of angularly configured rails for each limb (arm and leg) of the trainee user of the holistic training device of the invention.

FIG. 7*a* illustrates in perspective a standard pair of the rails employed at the right side and a standard pair of the rails employed at the left side, such rails being illustrated in FIG. 7.

FIG. 8*a* illustrates a covering mat of the frame and FIG. 8*b* illustrates the relevant adjustable pillow and monitor, whilst FIG. 8*c* illustrates a peripheral lateral covering member of the frame.

DETAILED DESCRIPTION OF PREFERRED EMBODIMENTS OF THE INVENTION

Referring now to the accompanying drawings we will describe indicative preferred embodiments of the invention.

Figure 3A:
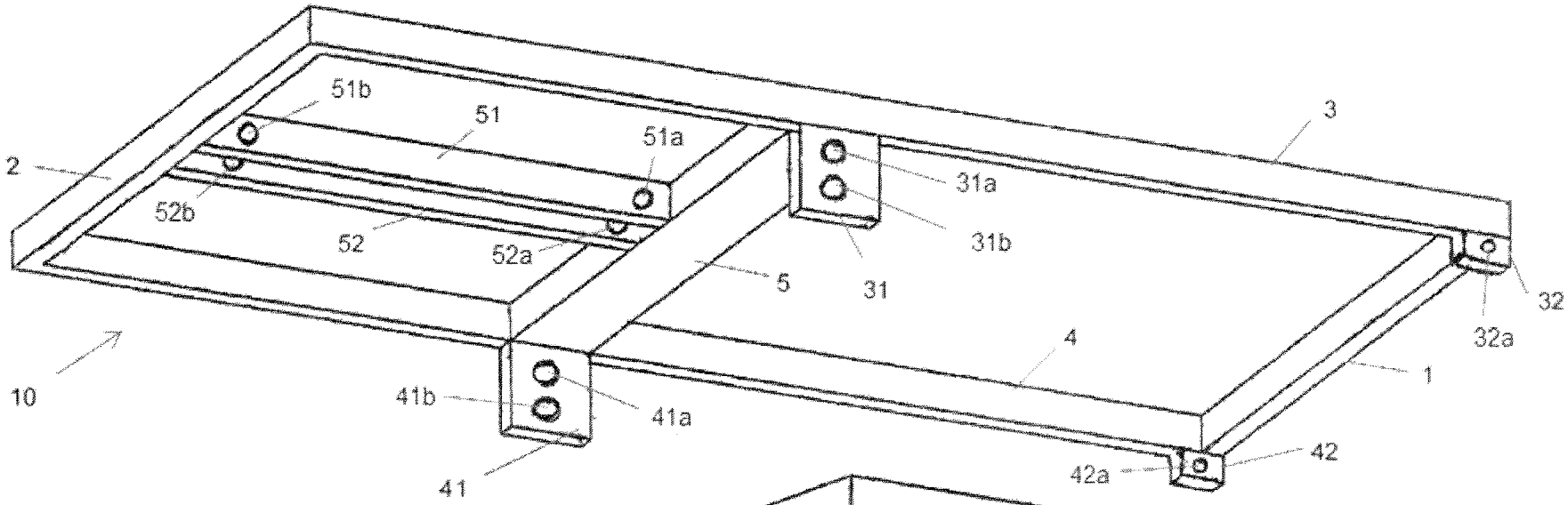
FIGS. 3*a* and 3*b* present in perspective two pictures of the bottom side of the frame of the holistic training device of the invention.
Figure 3B:
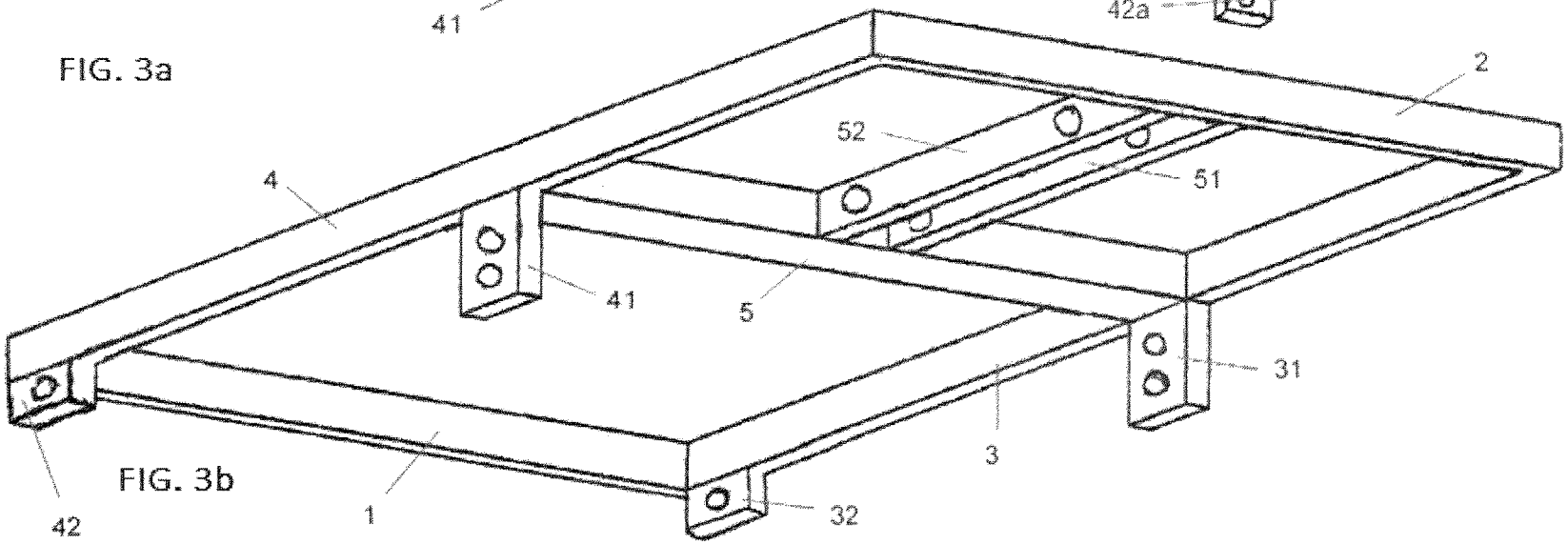

The holistic training device of the invention is assembled onto frame 10 that is depicted in FIGS. 3*a* and 3*b*. Frame 10 has a rectangular form with a pair of shorter parallel beams 1, 2 which are located respectively proximally to the head and proximally to the feet of the trainee user and a pair of longer parallel beams 3, 4 that are respectively located along the right and the left side of the torso of the trainee user. An additional beam 5 extends transversely, parallel to the aforementioned shorter parallel beams 1, 2 of frame 10. Plate extensions 31 and 41 are provided downwardly the longer parallel beams 3, 4 at both sides of the above transversely extending beam 5, wherein each of the aforementioned plate extensions 31 and 41 is provided with a pair of holes 31*a*, 31*b* and 41*a*, 41*b* respectively. There is an additional pair of plate extensions 32 and 42 with a hole 32*a* and 42*a* respectively provided downwardly at the ends of the beam 1 of frame 10. There is a pair of parallel beams 51, 52 that connect the aforementioned beam 5 and beam 2 of frame 10, wherein beams 51, 52 extend parallel to the aforementioned longer parallel beams 3, 4 of frame 10, one end of these beams 51, 52 proximally to the beam 5 being provided with through holes 51*a*, 52*a* respectively aligned and facing each other and the other end of these beams 51, 52 proximally to the beam 2 being provided with also respectively aligned and facing each other through holes 51*b*, 52*b*.

Figure 12A:
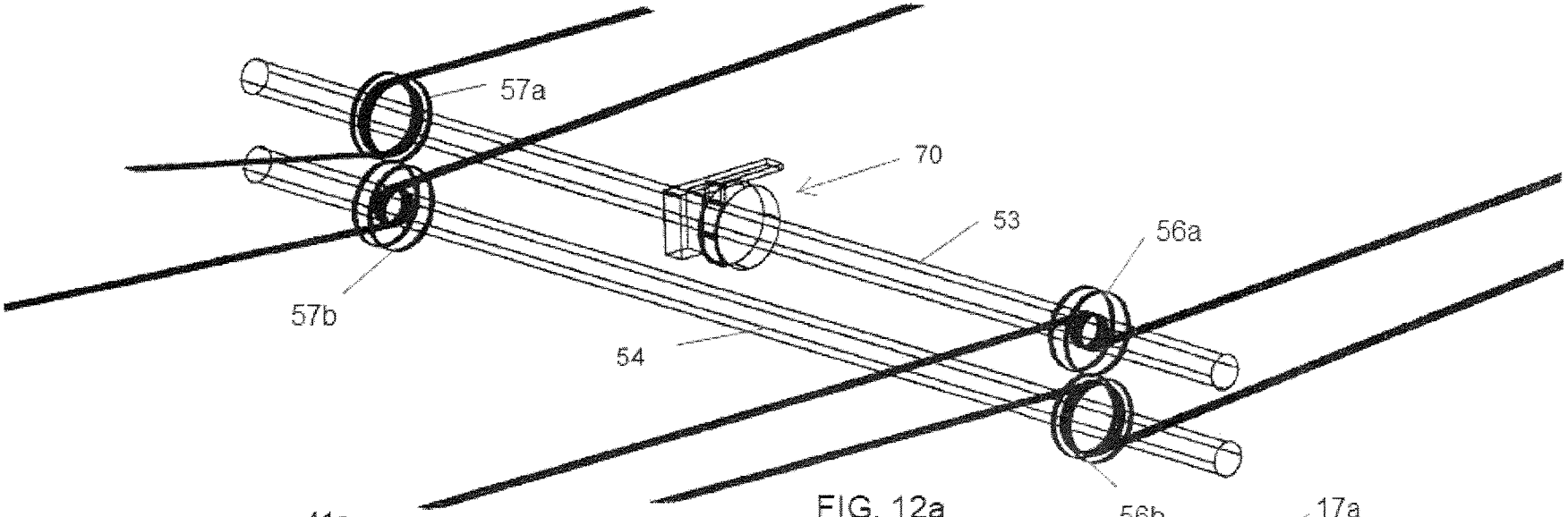
FIG. 12*a* illustrates a detail of the synchronized winding and unwinding of straps around the pulleys mounted onto the pair of axles shown in FIG. 12, on one hand of the first pair of straps activated by the right limbs (arm and leg) of the trainee user and on the other hand of the second pair of straps activated by the left limbs (arm and leg) of the trainee user.
Figure 12:
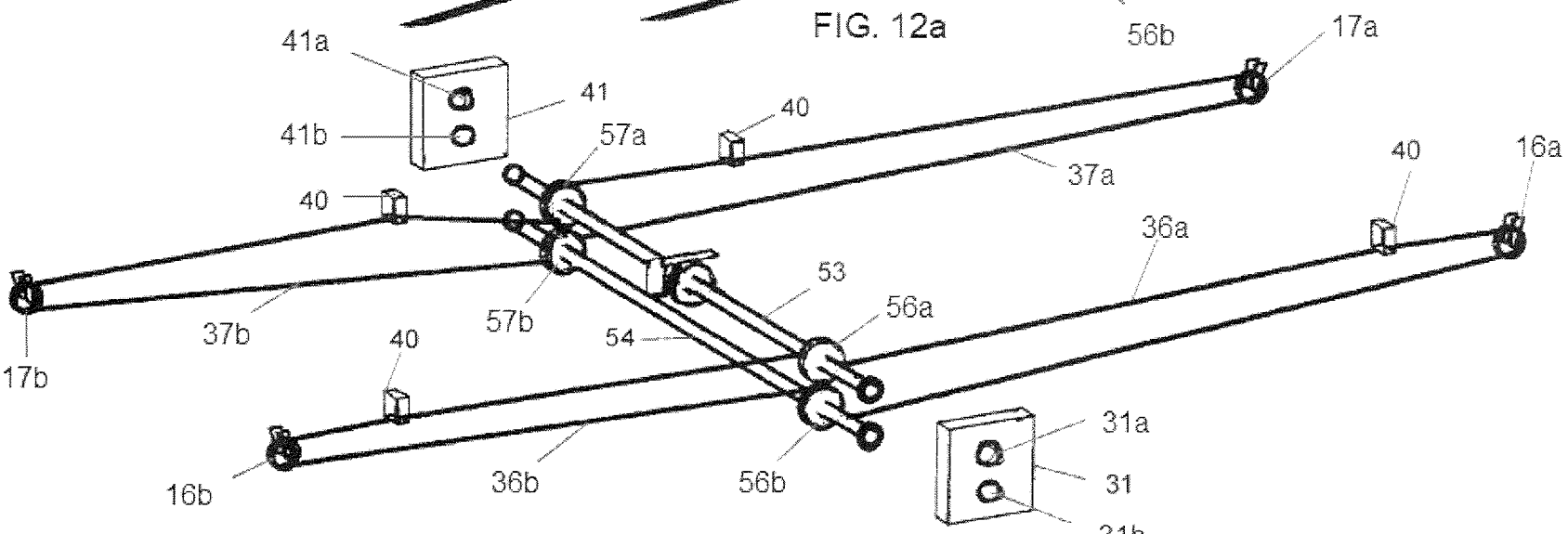
FIG. 12 illustrates an arrangement of straps extending from the upper to the lower side of the frame and passing through pulleys of a transversely extending pair of axles of the arrangement of synchronized movement of the straps.
Figure 15B:
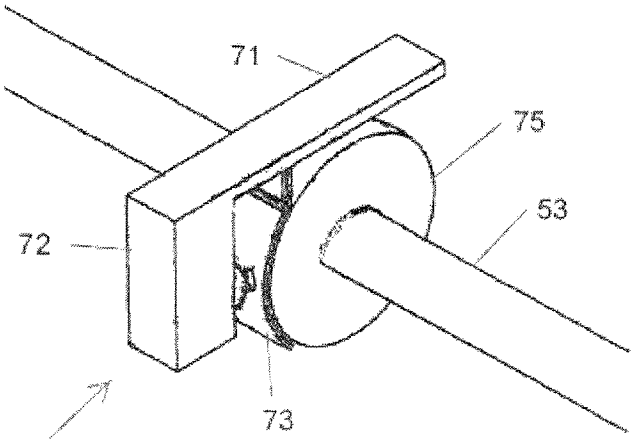
FIG. 15*a* illustrates a side view and FIG. 15*b* illustrates a perspective view of the braking arrangement of FIG. 15 being applied onto the disc mounted at the upper axle of the arrangement of synchronized movement of the straps.
Figure 15A:
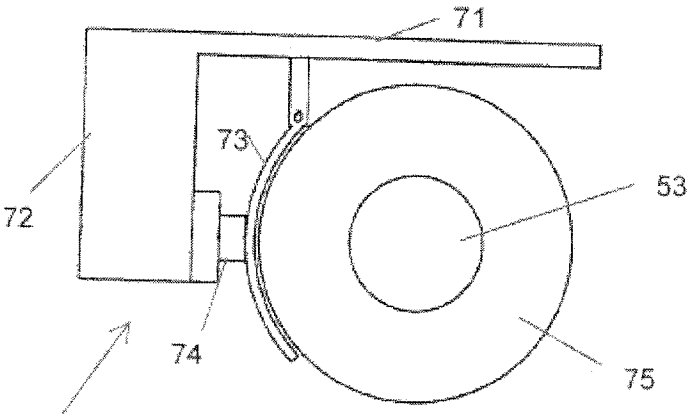
Figure 15:
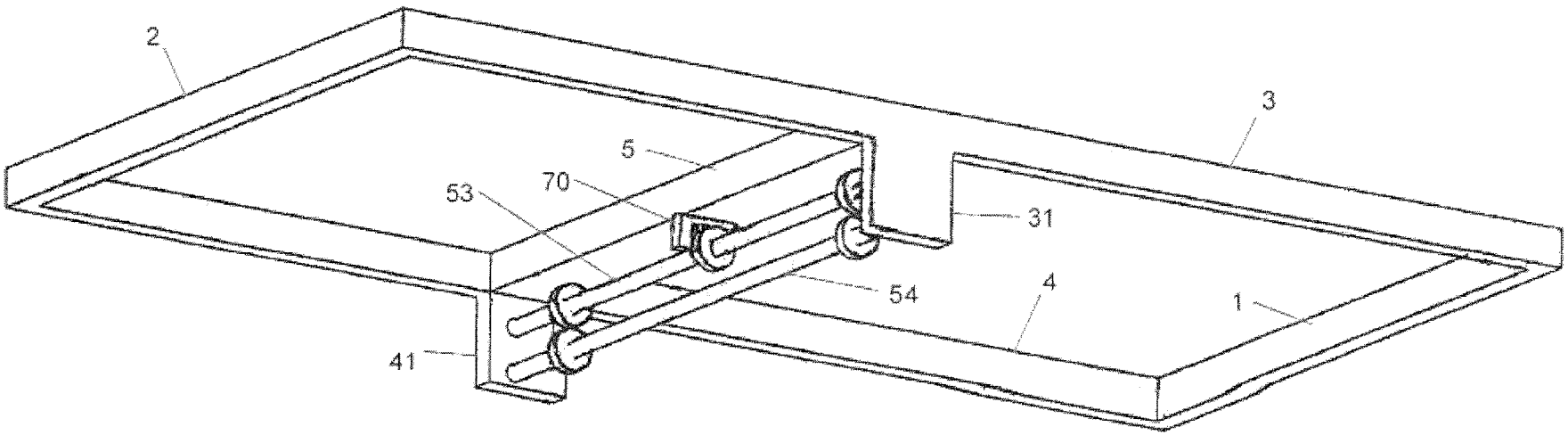
FIG. 15 illustrates a perspective view of the frame of the proposed holistic training device with a braking arrangement installed at the center of the intermediate transversely extending beam of the frame, such braking arrangement having the capacity to exert a braking pressure onto a disc that is securely fixed at the center of an upper axle of the arrangement of synchronized movement of the straps.

The proposed holistic training device includes an arrangement of elements for the intended exercise during which the trainee stabilizes the palms of his hands onto the handgrips and the soles of his feet within the foot holds, such handgrips and foot holds being provided along the right and along the left side of the device. Thereafter the trainee may initiate execution of the training operation proposed in the present invention, such training operation comprising sequential cycles of a first step of synchronized contraction of left limbs and extension of right limbs followed by a second step of reverse synchronized contraction of right limbs and extension of left limbs. The aforementioned proposed arrangement of elements adapted to be used in the intended exercise further comprises:

A pair of freely rotatable axles 53, 54 illustrated in FIG. 15 and in FIGS. 12, 12*a*, wherein these axles 53, 54 have their ends inserted within the holes 31*a*, 41*a* and 31*b*, 41*b* of the abovementioned plate extensions 31, 41 respectively.

Figure 6C:
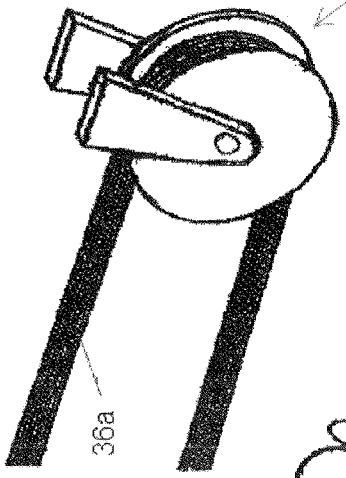
FIG. 6*c* illustrates in perspective a detail of an embodiment of the pulley illustrated in FIG. 6 at the upper right end of the frame with a strap section wrapped around it.
Figure 6B:
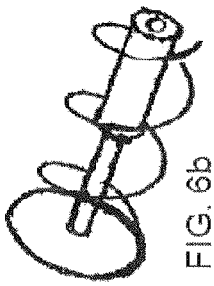
FIG. 6*b* illustrates in perspective a detail of an embodiment of the spring being illustrated in FIG. 6.
Figure 6A:
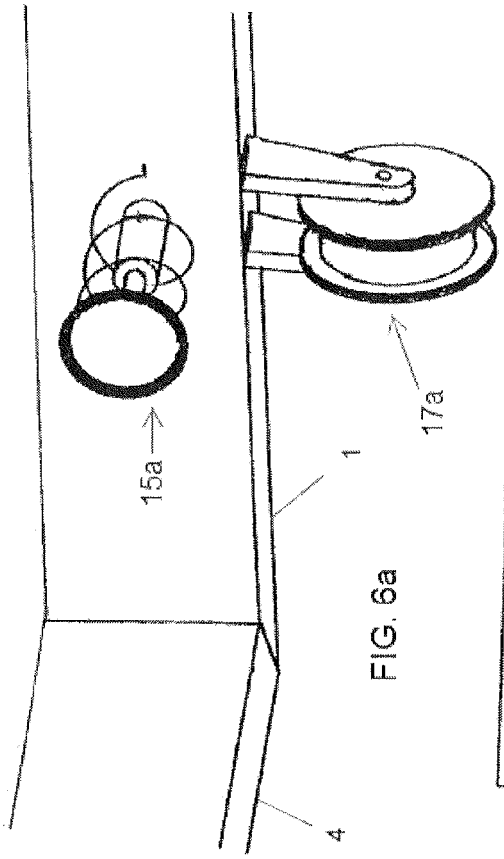
FIG. 6*a* illustrates in perspective a detail of the upper left side of the frame with a spring attached at the interior and an underlying pulley at the bottom surface of this side.
Figure 6:
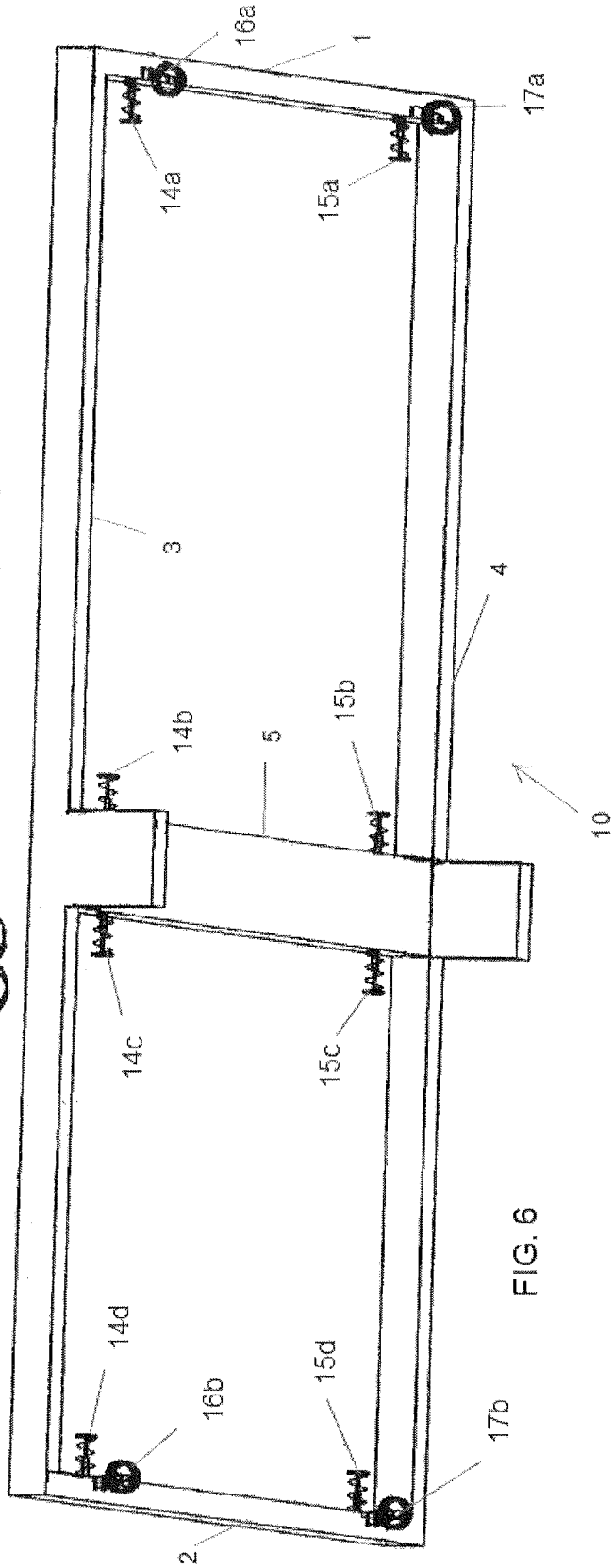
FIG. 6 illustrates in a perspective sketch the lower side of the frame with pairs of pulleys and springs attached onto the upper and bottom side thereof and with pairs of springs attached on either side of the intermediate beam of the frame.

Pulleys 56*a*, 57*a* and 56*b*, 57*b* fixedly mounted close to the ends on both sides of axle 53 and axle 54 respectively (FIG. 12, 12*a*) and pulleys 16*a*, 17*a* and 16*b*, 17*b* close to the ends on both sides of beam 1 and of beam 2 of frame 10 respectively (FIG. 6).

Figure 10A:
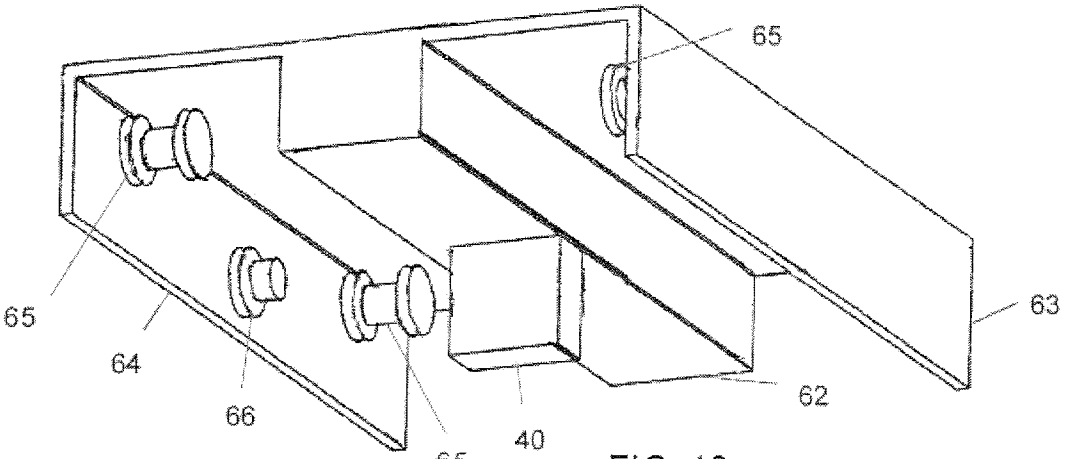
FIG. 10*a* illustrates in perspective the bottom side of the platform that is depicted in FIG. 9, such platform being adapted to receive a handgrip or a foot hold of the trainee user
Figure 10B:
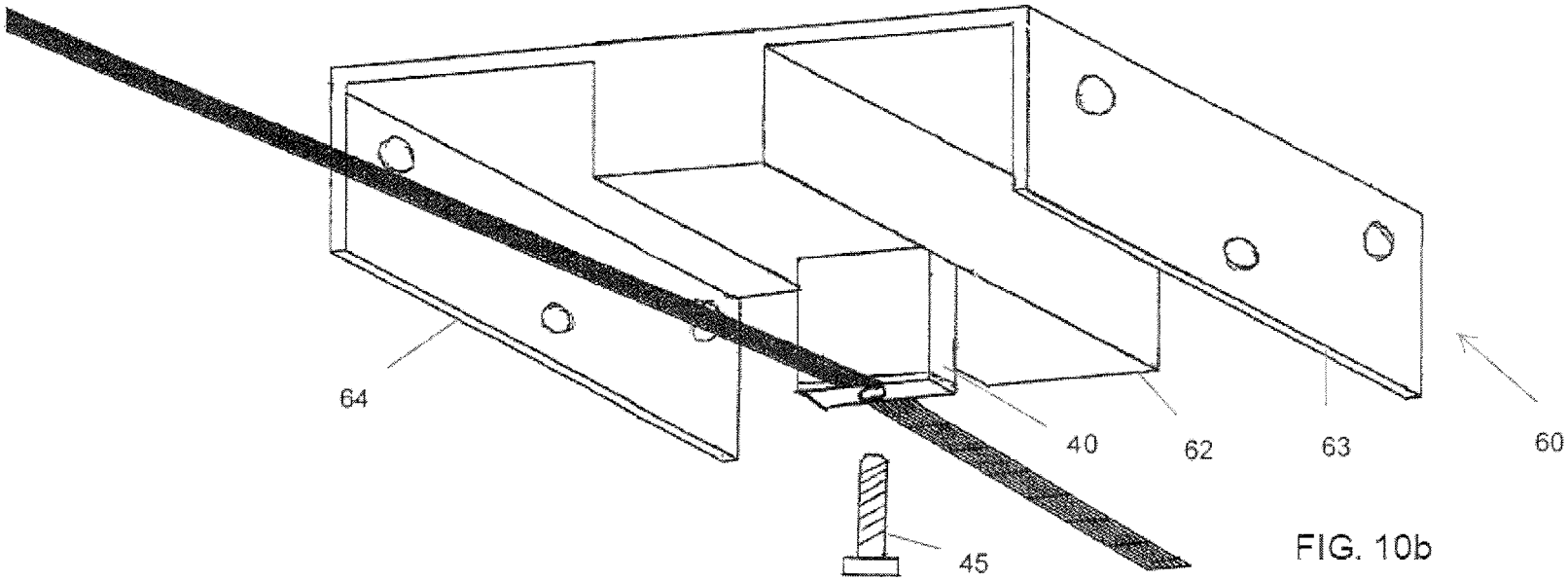
FIG. 10*b* illustrates in perspective the bottom side of the platform whilst it is being connected to an underlying strap.

A pair of straps 36*a*, 36*b* as illustrated in FIGS. 12, 12*a*, such straps 36*a*, 36*b* extending close to and parallel to the elongate beam 3 at one side of the device and a pair of straps 37*a*, 37*b* also illustrated in FIGS. 12, 12*a*, such straps 37*a*, 37*b* extending close to and parallel to the elongate beam 4 of frame 10 at the other side of the device, wherein straps 36*a*, 37*a* are shown being located between beam 1 and beam 5 and straps 36*b*, 37*b* are shown being located between beam 2 and beam 5, with each of the straps 36*a*, 36*b*, 37*a*, 37*b* being provided with a protruding member 40, which, as illustrated in FIG. 10*b*, is fixedly connected to a platform 60 that is described hereinbelow, such connection resulting in the strap following the movement of the platform.

A pair of rails 33, 34 extending parallel to and close to the beam 3 and another pair of rails 43, 44 extending parallel to and close to the beam 4 of frame 10, wherein the rails 33, 34 and 43, 44 are illustrated in FIGS. 7 and 7*a*. Each rail of the abovementioned pairs of rails 33, 34 and 43, 44 has an angular configuration with a horizontally extending portion adapted to receive a platform 60 sliding thereupon and a vertically extending portion underlying and perpendicular to the horizontally extending portion, An illustrative sketch of the rails 33, 34 whereupon slide such platforms 60 through movement of the corresponding handgrip items of the trainee user of the device are depicted in FIGS. 11*c*, 11*d* and 11*e*.

Figure 9A:
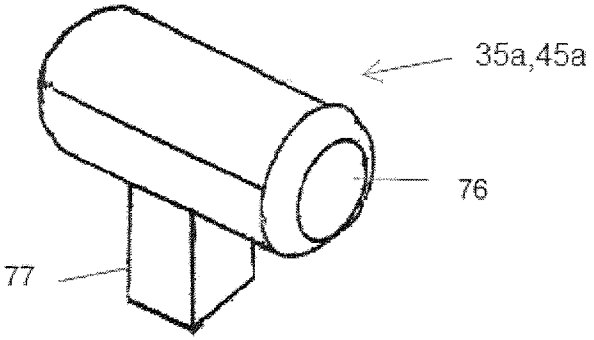
FIG. 9*a* illustrates an indicative embodiment of a handgrip member and FIGS. 9*b* and 9*c* illustrate indicative embodiments of a foot hold member.
Figure 9C:
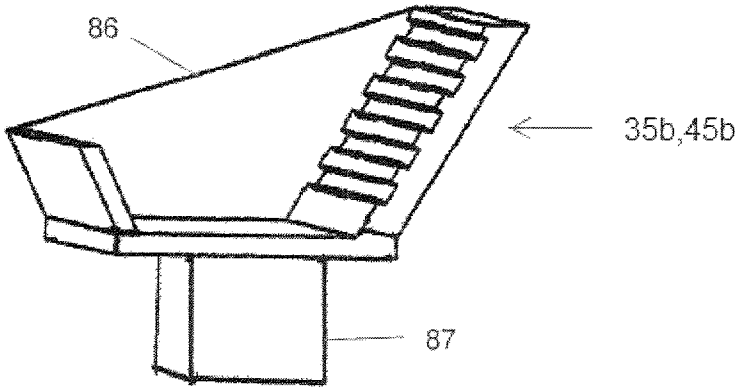
Figure 9B:
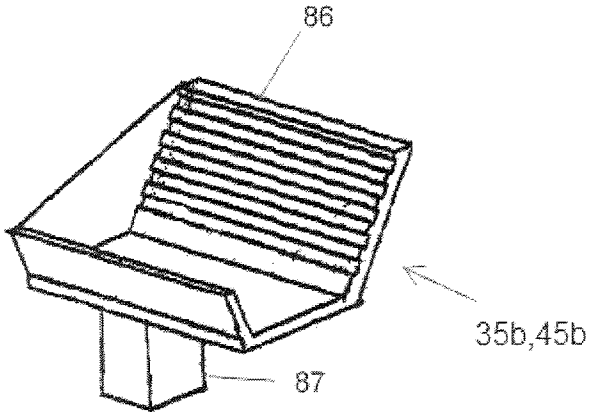
Figure 9:
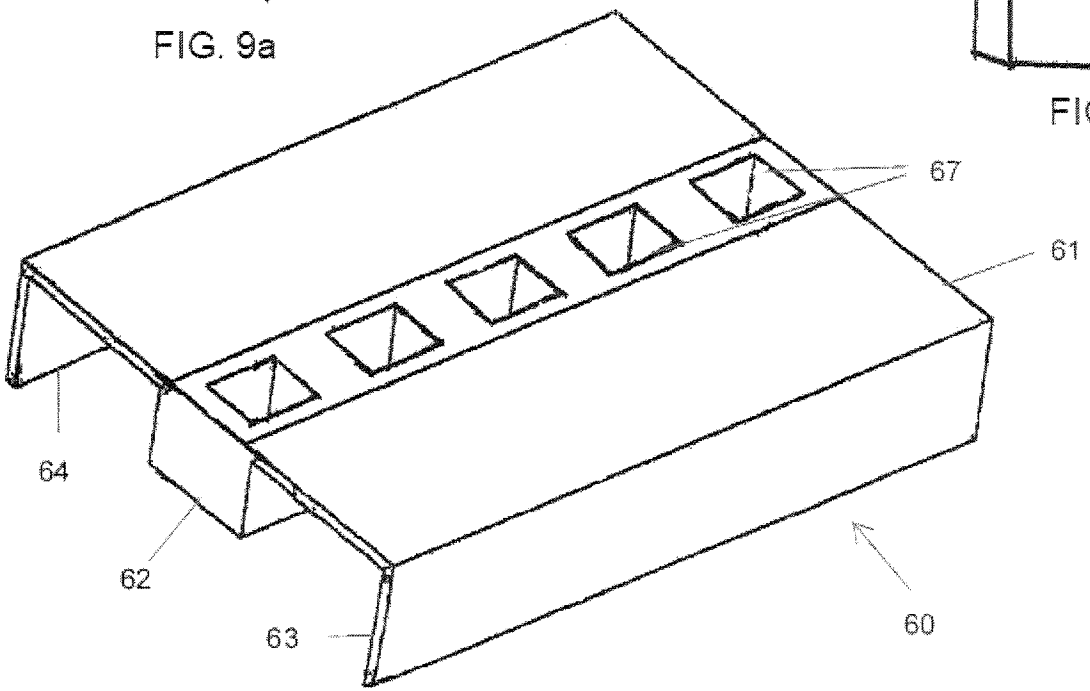
FIG. 9 illustrates in perspective a platform adapted to receive a handgrip or a foot hold member of the trainee user and intended to slide along a pair of rails indicatively illustrated in FIGS. 7, 7*a*.
Figures 11A, 11B, 11C, 11D, 11E:
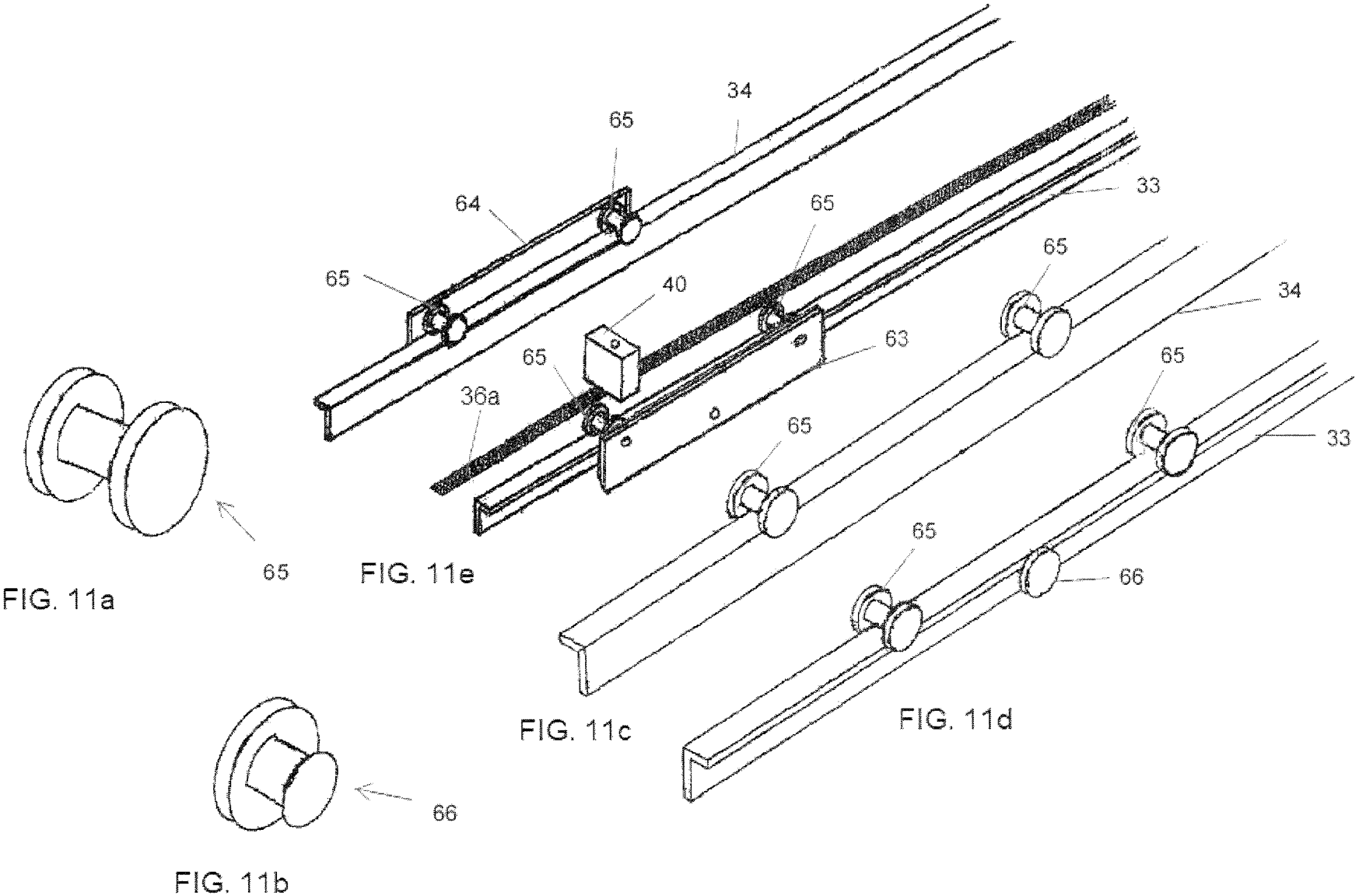
FIGS. 11*a* and 11*b* show two types of the wheels which are attached at the interior of the side walls of each platform to provide sliding thereof onto a pair of rails.
FIG. 11*c* shows the rail indicatively illustrated in FIGS. 7, 7*a*, that is of a rail adapted to receive the platform of an arm of the trainee user and of the wheels mounted therein to allow sliding thereupon of the platform.
FIG. 11*d* shows the rail indicatively illustrated in FIGS. 7, 7*a*, that is of a rail adapted to receive the platform of an arm of the trainee user and of the wheels mounted therein to allow sliding thereupon of the platform including an underlying wheel that supports it.
FIG. 11*e* illustrates a pair of rails, indicatively of the right side of the frame including the side walls of a platform moving thereupon when activated by a handgrip of the trainee user, wherein the side walls of the platform are provided with wheels adapted to provide sliding and support thereof with a portion of a strap being depicted including a protruding member thereof adapted to provide connection of the strap to the platform.

A platform 60 for each of the straps 36*a*, 36*b*, 37*a*, 37*b*, which, as illustrated in FIG. 9, comprises a flat surface 61 with an underlying centrally located box structure 62 and underlying parallel side walls 63, 64 on either side thereof, wherein the platform 60 is configured to have a width that covers the distance between the two rails 33, 34 or 43, 44 and is appropriately sitted onto them as illustrated in FIG. 11*e*. Each of the parallel side walls 63, 64 of a platform 60 is provided with a pair of longitudinally spaced wheels 65 fixedly mounted thereupon and with a wheel 66 that is provided intermedially between these wheels 65, such arrangement of wheels being illustrated in FIG. 10*a*, whilst FIGS. 11*a* and 11*b* provide a perspective view of wheel 65 and wheel 66 respectively. The pair of wheels 65 of parallel side walls 63, 64 is adapted to support and allow sliding of a platform 60 onto the horizontally extending portion of the rails 33 and 34 of the pair of rails 33, 34 (as illustrated in FIGS. 11*c*-11*e*) or onto the rails 43 and 44 of the pair of rails 43, 44. The wheel 66 that is provided intermedially between the pair of wheels 65 is adapted to abut a bottom surface of the horizontally extending portion of the rails 33 and 34 of the pair of rails 33, 34 or of the rails 43 and 44 of the pair of rails 43, 44 thereby supporting the platform and averting an upward or downward displacement thereof. As shown in FIG. 10*b*, the protruding member 40 of each of the straps 36*a*, 36*b*, 37*a*, 37*b* is connected to the underlying centrally located box structure 62 of the platform 60 with a screw 45, such connection resulting in the strap following the movement of the platform. An array of holes 67 is provided onto the upper flat surface 61 in the region of the centrally located box structure 62 of the platform 60, such array of holes 67 being adapted for the reception of driving shafts 77 of the handgrips 35*a*, 45*a* and of driving shafts 87 of the foot holds 35*b*, 45*b* of the trainee user, wherein a specific hole 67 is appropriately selected to match the height of each particular user of the device.

In accordance to one embodiment of the invention, FIG. 9*a* illustrates a handgrip item 35*a*, 45*a* that comprises a shaft 76 which is suitable for the secure grip in the palm of the average user and, furthermore, FIGS. 9*b* and 9*c* illustrate a foot hold 35*b*, 45*b*, which comprises a structure 86 adapted to firmly nest a frontal foot sole portion including metatarsal bones of an average user in a position that will avert undesirable sliding thereof. As mentioned hereinabove, the handgrip 35*a*, 45*a* extends to a shaft 77 and the foot hold 35*b*, 45*b* extends to a shaft 87, these shafts 77, 87 being of the same caliber with the holes 67 of platform 60 illustrated in FIG. 9 so that they may fit within a selected hole of the array of holes 67 and secure therein the handgrips and the foot holds. A hole of the array of holes 67 is appropriately selected so as to correspond to the physique and in particular to the height of each user intending to use the device thereby allowing a handy performance of the exercise of sequential contraction and extension of left and right limbs of the user of the device. The fact that the handgrips 35*a*, 45*a* and the foot holds 35*b*, 45*b* are detachable and they may be inserted or withdrawn from the holes 67, as described hereinabove, provides the possibility to the trainee user to select, if he so wishes, the use of only one of the two handgrips 35*a*, 45*a* or only one of the two foot holds 35*b*, 45*b*, so that only three of his four limbs indergo training with the holistic training device. It is therefore noted that if one of the two handgrips 35*a*, 45*a* or one of the two foot holds 35*b*, 45*b* is withdrawn, the trainee user can concentrate training to those parts of his body that undergo training with the holistic training device. According to a preferred embodiment of the invention, the handgrips 35*a*, 45*a* are oriented with the cylindrical shaft 76 extending vertically along the direction of movement of platforms 60. This particular orientation of the handgrips

35*a*, 45*a* helps to achieve the extreme extension of the arms of the trainee user during operation of the holistic training operation.

Figure 13B:
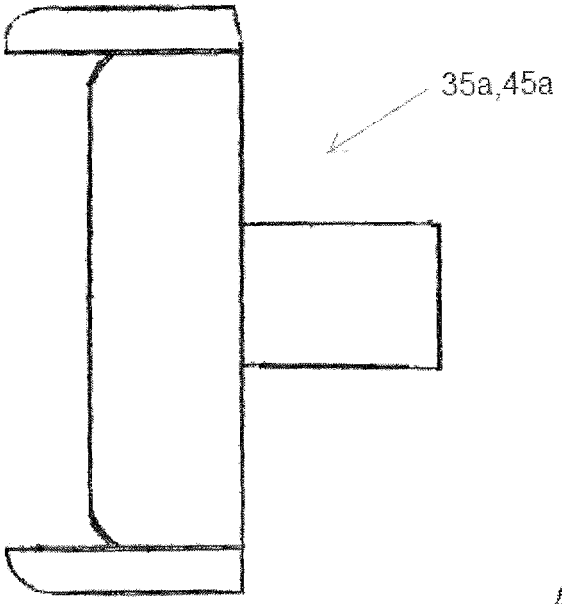
FIG. 13*b* illustrates a sectional view of the assembled handgrip item of FIG. 13.
Figure 14:
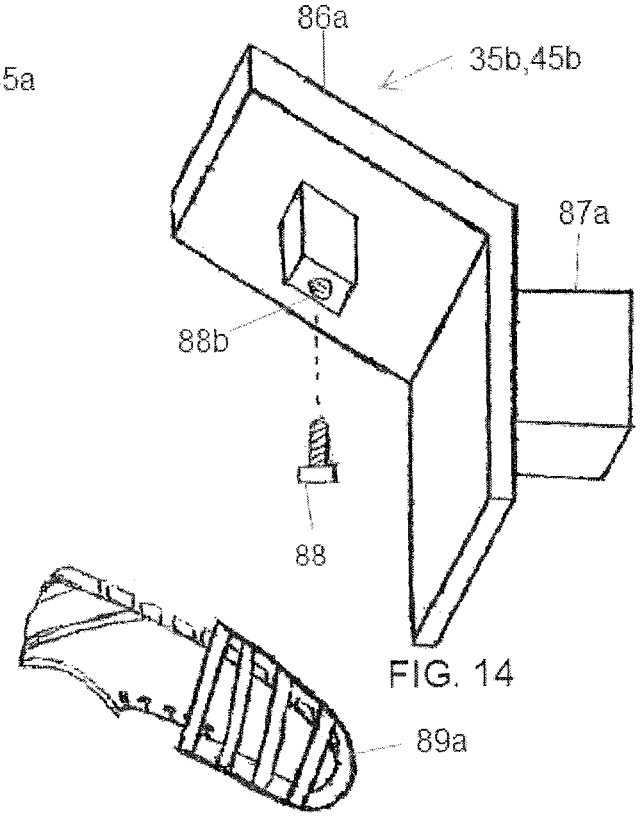
FIG. 14 illustrates in perspective an exploded view of an alternative embodiment of the foot hold item of the present invention.
Figure 13A:
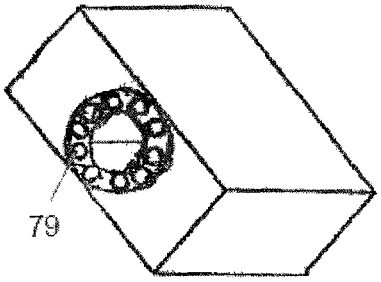
FIG. 13*a* illustrates a rear view of a shaft member of the handgrip item shown in FIG. 13 that is provided with a ball bearing allowing free rotation of the body of the handgrip around this shaft.
Figure 14A:
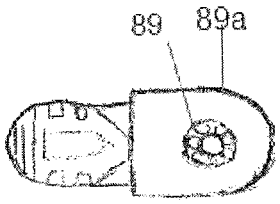
FIG. 14*a* illustrates in perspective the footwear of a trainee user which is adapted to be inserted within the foot hold item illustrated in FIG. 14.
Figure 13:
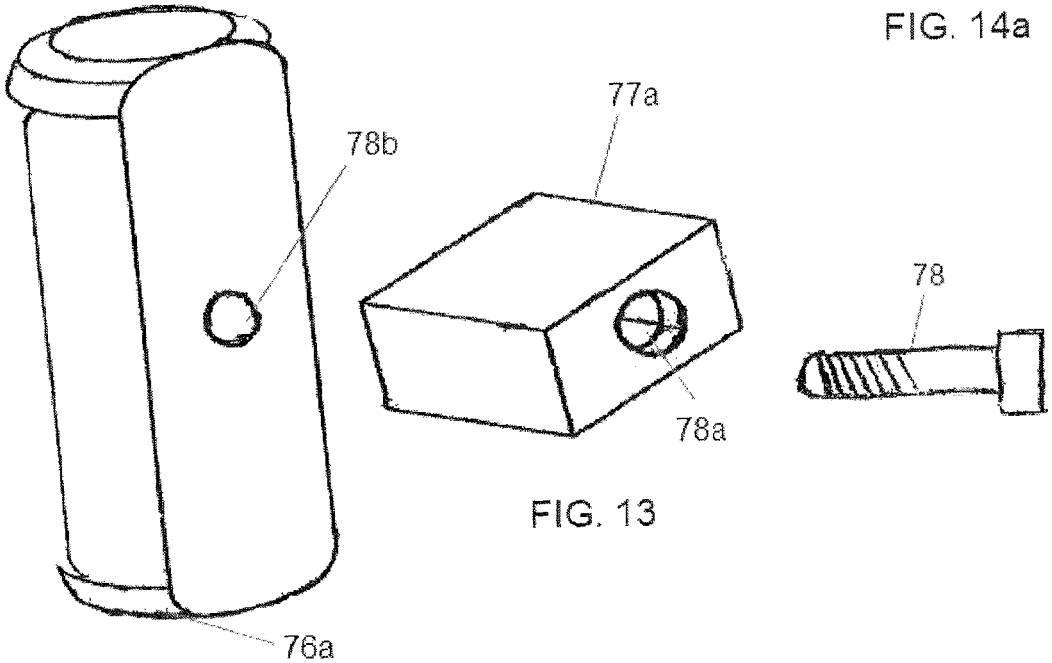
FIG. 13 illustrates in perspective an exploded view of an alternative embodiment of the handgrip of the present invention.

At an advanced level of execution of the exercise, it is possible to use the handgrips illustrated in FIGS. 13, 13*a*, 13*b* and/or the foot holds illustrated in FIGS. 14, 14*a* respectively. In this embodiment the handgrip 35*a*, 45*a* includes a shaft 76*a* which is attached to a freely rotating shaft 77*a*, the attachment being effected with a pin 78 that passes through a hole 78*a* provided with a ball bearing 79 that fits within a hole 78*b* that is located centrally along the shaft 76*a*. Respectively, the foot holds 35*b*, 45*b* that are illustrated in FIGS. 14, 14*a* comprise an open inclined surface 86*a* instead of the delimited space 86 of the embodiment shown in FIGS. 9*b*-9*c*, wherein a protruding member with a hole 88*b* being employed to connect the sole portion of the trainee through a connecting pin 88 that has previously passed through a ball bearings 89 mounted at a frontal portion 89*a* of the footwear of the trainee as illustrated in FIG. 14*a*.

This embodiment of the foot holds 35*b*, 45*b* provides a freedom of movement around the ball bearing 89 during operation of the device of the invention. It is hereby evident that exercising levels of increased difficulty may be achieved through selection of the handgrips and foot holds depicted in FIGS. 13, 13*a*, 13*b* and FIGS. 14, 14*a* respectively. An experienced advanced user may therefore use handgrips and/or foot holds of these embodiments with a scope of achieving the workout and strengthening of the muscles and tendons of the hand palm and the foot sole in particular.

As illustrated in FIG. 6, frame 10 is provided with the aforementioned pairs of pulleys 16*a*, 17*a* and 16*b*, 17*b* at the interior of the upper side of beam 1 and of the bottom side of beam 2 respectively. A pair of springs 14*a*, 15*a* and 14*d*, 15*d* are also provided at the interior of the upper side of beam 1 and at the interior of the bottom side of beam 2 respectively. An additional pair of springs 14*b*, 15*b* facing towards beam 1 is located at the interior of the intermediate transversely extending beam 5 and another pair of springs 14*c*, 15*c* facing towards beam 2 is located at the interior of the same transversely extending beam 5. Illustrative embodiments of the aforementioned springs and pulleys are respectively depicted in FIGS. 6*b* and 6*c*, while FIG. 6*a* depicts a detail of the upper left (as viewed from bottom to top) side of frame 10 with the spring 15*a* being attached to the interior of beam 1 of frame 10 and with an underlying pulley 17*a* being mounted at the bottom of the same beam 1.

Each of the aforementioned platforms 60 is arranged so that the centrally located box structure 62 thereof extends parallel to the underlying strap 36*a* or 36*b* of the right side and 37*a* or 37*b* of the left side and so that such centrally located box structure 62 follows the movement of platform 60, that is activated by the trainee who moves the aforementioned items of handgrips 35*a*, 45*a* and of foot holds 35*b*, 45*b*, thereby executing a stroke being delimited by ends encountered by the centrally located box structure 62 as it bumps against the springs 14*a*, 14*b* and 15*a*, 15*b* respectively provided onto frame 10 for the platforms 60 moved by the handgrips 35*a*, 45*a* respectively and against the springs 14*c*, 14*d* and 15*c*, 15*d* respectively provided onto frame 10 for the platforms 60 moved by the foot holds 35*b*, 45*b* respectively. It is herein noted that the bumping against the aforementioned springs provides the capacity of absorption of vibrations and provides a thrust that assists to reverse the movement of the platforms 60 towards the opposite direction.

Figure 1:
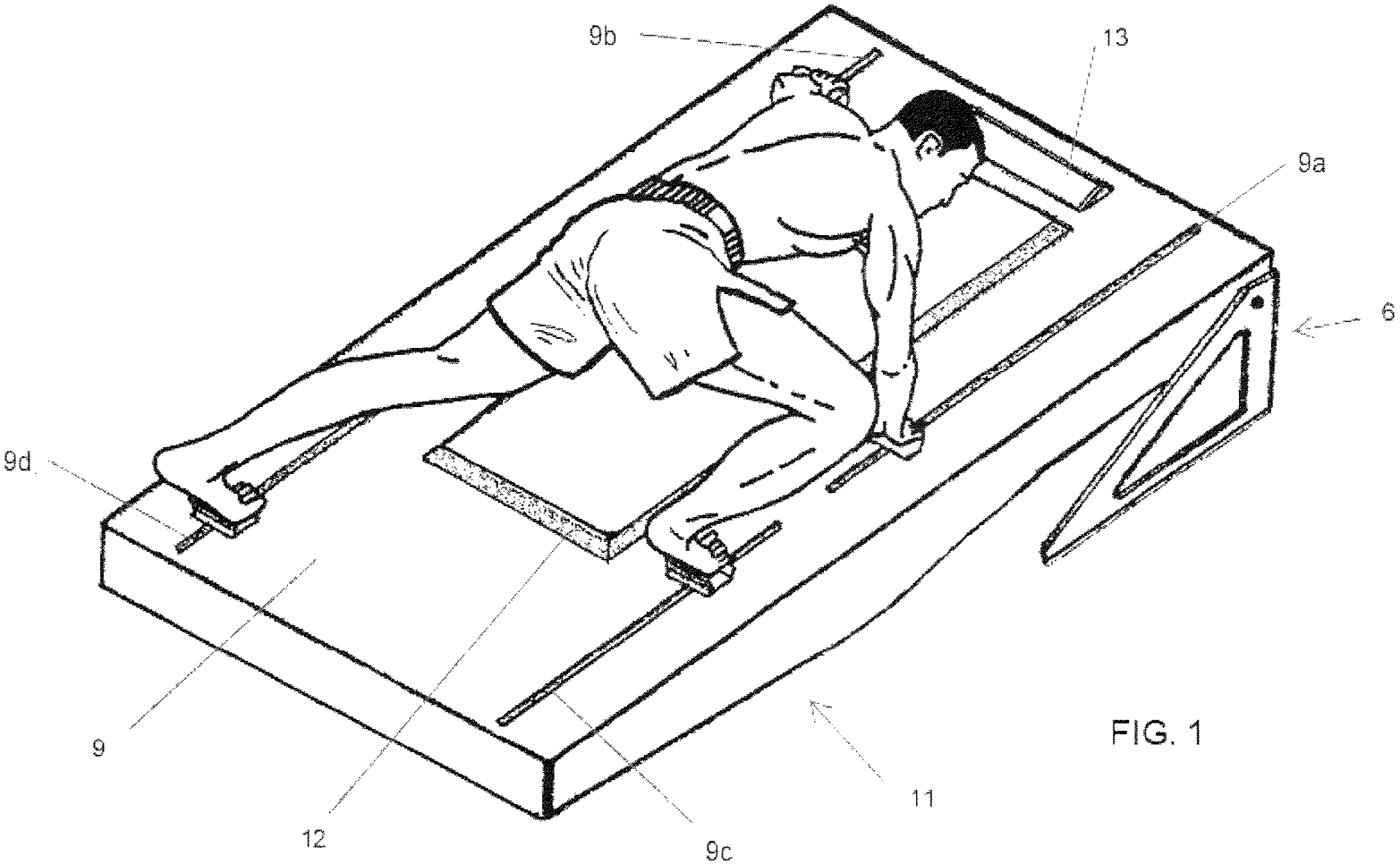
FIG. 1 shows the proposed holistic training device with the trainee user thereupon at a first position of contraction of his right and extension of his left limbs.
Figure 2:
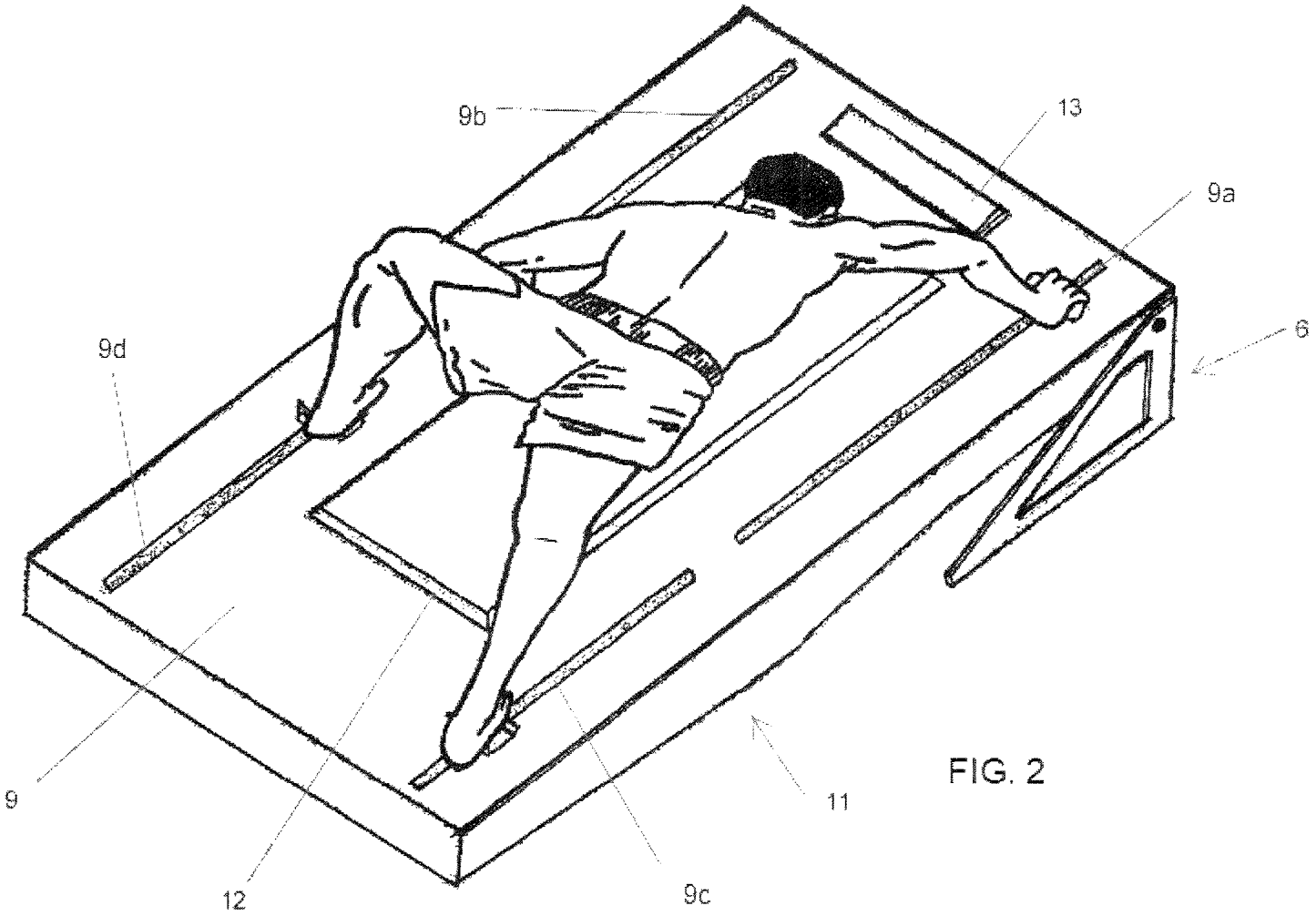
FIG. 2 shows the proposed holistic training device with the trainee user thereupon at a second position of contraction of his left limbs and extension of his right limbs.

It is noted that, during an abovementioned first step of the exercise; as the arms and legs of one side of the user reach the ends of an extension stroke, as happens with the right side of the user in FIG. 2, at the same time, the arms and legs of the other side of the user reach the ends of a contraction stroke, whereby all four platforms 60 bump simultaneously against the springs 15*a* and 15*d* of one side and against the springs 14*b*, 14*c* of the other side of the trainee user. Respectively, during an abovementioned second step of the exercise, as the arms and legs of the side of the trainee that had previously performed an extrension now perform a contraction stroke, and the arms and legs of the side of the trainee that had previously performed a contraction now perform an extrension stroke. During execution of this second step of the exercise, as illustrated in FIG. 1, the four platforms 60 bump simultaneously against the springs 15*b* and 15*c* of the right side and the springs 14*a*, 14*d* of the left side. Moreover, it is noted that frame 10 has such a length and width so that the arms and legs of one side of even a very tall trainee user also having an extended shoulder width can cover the entire stroke of a full extension and, at the same time, the arms and legs of the other side of such a trainee user can cover the entire stroke of a full contraction during operation of the exercise with the holistic training device of the invention.

In order to ensure the intended synchronization in the movement of the straps 36*a*, 36*b* of the right side and of the straps 37*a*, 37*b* of the left side of frame 10, their adjustment to the respective pulleys 56*a*, 56*b* and 57*a*, 57*b* takes place as follows:

On the right side of frame 10, connection of one end of the strap 36*a* to the lower side of the pulley 56*a* and of the other end of the same strap to the lower side of the pulley 56*b* and connection of one end of the strap 36*b* to the upper side of the pulley 56*a* and of the other end of the same strap to the upper side of the pulley 56*b*. Respectively, at the left side of frame 10, the connections are reversed, that is, the connection of one end of the strap 37*a* is made to the upper side of the pulley 57*a* and of the other end of the same strap is made to the upper side of the pulley 57*b*, while the connection of one end of the strap 37*b* is made to the lower side of the pulley 57*a* and of the other end of the same strap is made to the lower side of the pulley 57*b*.

The aforementioned connections of the ends of straps 36*a*, 36*b* and of the ends of straps 37*a*, 37*b* with the pulleys 56*a*, 56*b* and 57*a*, 57*b* respectively, as well as the fact that the pulleys 56*a*, 57*a* and 56*b*, 57*b* are fixedly mounted close to the ends of axle 53 and close to the ends of axle 54 respectively leads to the achievement of the intended synchronization in the movement of the straps 36*a*, 36*b* of the right side and of the straps 37*a*, 37*b* of the left side of frame 10. It must be noted that "synchronization" aims to mean the fully synchronized movement of the straps 36*a*, 36*b* and of the straps 37*a*, 37*b* that is manifested in the device of the invention wherein the movement of any single one of the four straps is necessarily followed by an equivalent movement of each and every one of the other three straps thereby providing a fully synchronized movement of all straps. This result is achieved through the appropriate aforementioned connection of each of the four straps onto the four pulleys 56*a*, 56*b*, 57*a*, 57*b*, wherein the movement of each of the four pulleys 56*a*, 56*b*, 57*a*, 57*b* is fully synchronized and followed by the movement of the other three pulleys. Moreover, this results in the movement of each of the platforms 60 which is connected to one of the straps 36*a*, 36*b*, 37*a*, 37*b* to be fully synchronized and followed by the movement of the other three platforms 60 that are connected to the other three straps. A characteristic feature of the connectivity of the straps 36*a*, 36*b*, 37*a*, 37*b* to the pulleys 56*a*, 56*b*, 57*a*, 57*b* in the device of the present invention is the fact that each of the straps is connected to a pair of pulleys, that is, one end of each strap is connected to a first pulley and the other end of the same strap is connected to a second pulley underlying the first pulley and having the same diameter with the first pulley. Through this connectivity, the synchronized movement and execution of equivalent strokes of all platforms in the device of the present invention, as well as of the straps underlying the platforms and related to the movement of the arms and legs of the trainee user of the device is achieved. Due to the fact that the pulleys are fixedly mounted onto the parallel axles 53, 54, the movement of straps at one side of the device is equivalently transferred at the other side and due to the aforementioned reverse connection of the ends of the straps to the pulleys at the two sides of the parallel axles 53, 54, the movement effected at one side if the device is reversed at the other side thereof, i.e. in every execution cycle of the exercise that constitutes a training operation with the device of the invention, an operational effect of extension of arms and legs at one side of the device is combined with an operational effect of contraction of arms and legs at the other side thereof, whereby a simultaneous eventual operational effect of extension of arms and legs at one side and contraction of arms and legs at the other side of the device is achieved in each operational cycle of the device of the invention.

Thanks to the achievement of the aforementioned synchronization, the trainee user thus achieves sequential cycles of a first step of synchronized contraction of left limbs and extension of right limbs followed by a second step of reverse fully synchronized contraction of right limbs and extension of left limbs thereof. According to a preferred embodiment of the invention, the four straps 36*a*, 36*b*, 37*a*, 37*b* have the same length and the four pulleys 56*a*, 56*b*, 57*a*, 57*b* have the same caliber. Furthermore, according to a preferred embodiment of the invention, beam 5 is located at the center of frame 10 medially between beam 1 and beam 2 thereof and axle 53 is located directly above axle 54 also at the center of frame 10.

In accordance with an embodiment of the invention, frame 10 can rest on a flat floor through the protruding plate extensions 31 and 41 being respectively provided along the longer parallel beams 3, 4 at the sides of the abovementioned transversely extending beam 5 and through the additional pair of plate extensions 32 and 42 provided respectively at the sides of beam 1, wherein this is achieved provided that the protruding plate extensions 31, 41 and 32, 42 are of equal length so that frame 10 can rest at a horizontal position.

According to another preferred embodiment of the invention, frame 10 has an additional arrangement of supporting means that enable it to rest on a flat floor, which include on the one hand a pair of frontal supporting bases 6 that are connected at the ends on either side of beam 1 and on the other hand a rear supporting base 7, which is connected to the pair of beams 51, 52 and extends rearwardly in the direction of beam 2.

Figure 4B:
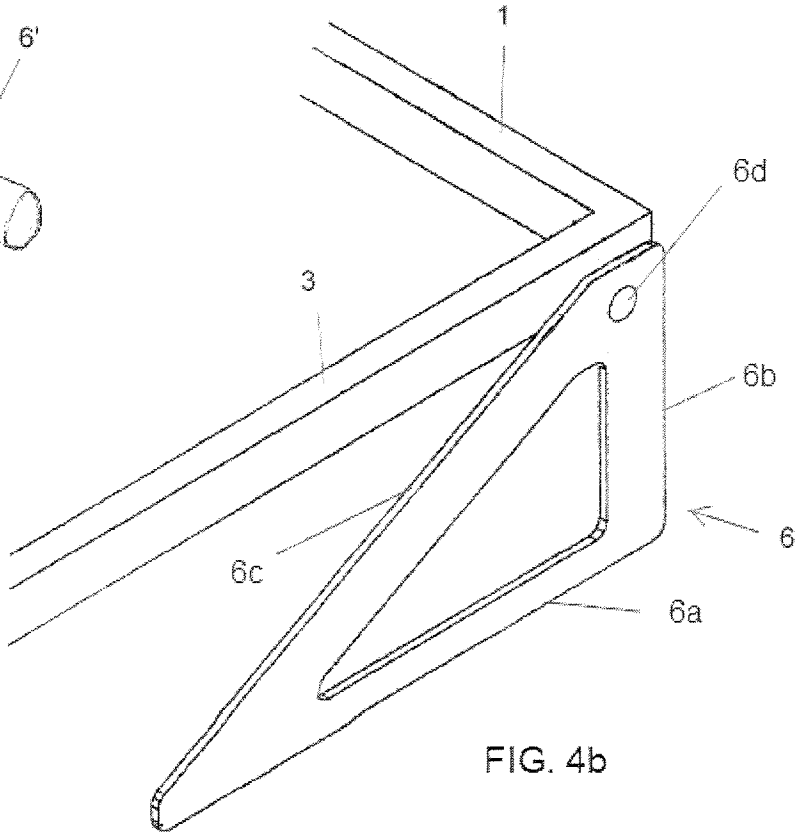
FIG. 4*b* illustrates a detail of the frontal right side of the frame wherein a triangularly configured supporting base has been connected.
Figure 4A:
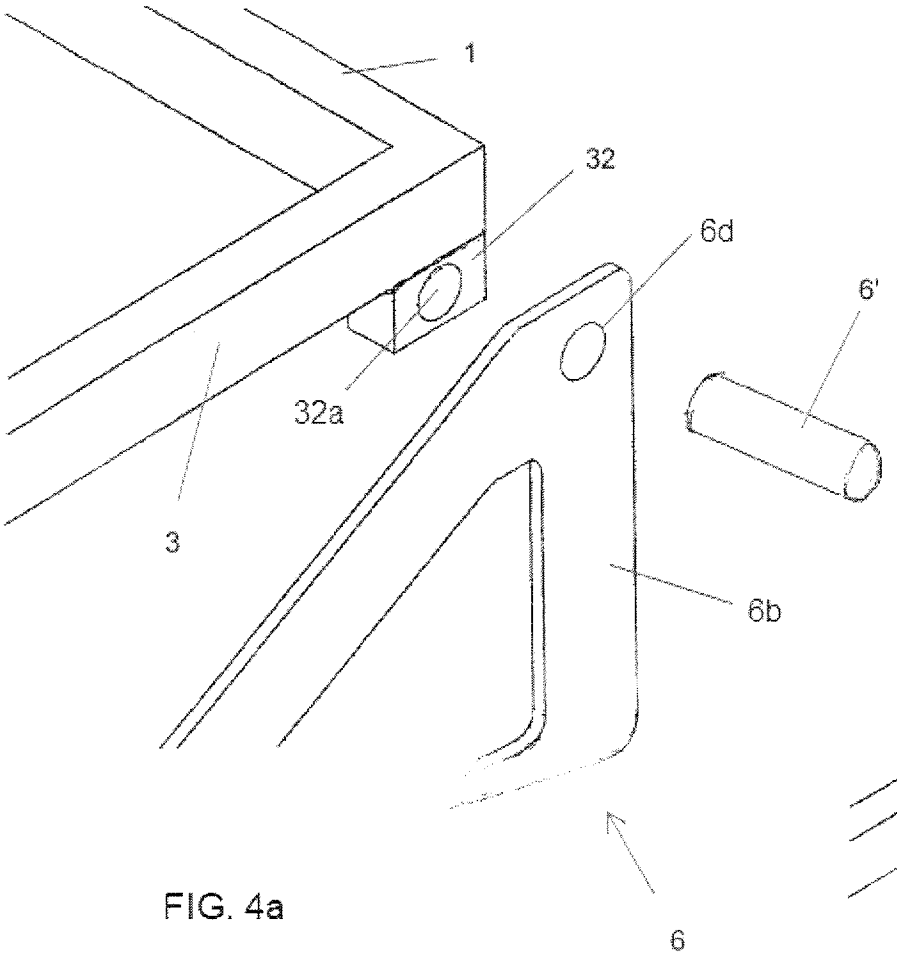
FIG. 4*a* illustrates in perspective a detail of a frontal supporting base of the frame shown in FIGS. 3*a* and 3*b*, a plate extension of the frame for the attachment of the supporting base and a pin adapted to provide connection of the base to the plate extension.

As illustrated in FIGS. 4*a* and 4*b*, the frontal side of frame 10 adapted to receive the overlying head of the trainee user comprises supporting bases 6 that are connected to the abovementioned plate extensions 32 and 42 provided at the right and left end of frontal beam 1. The supporting base 6 has the form of a right triangle with a first side 6*a* resting on the floor, a second side 6*b* perpendicular to the first side 6*a* extending vertically upwardly to a certain height of connection to frame 10 and a third side 6*c* that is the hypotenuse of the right triangle. A hole 6*d* is provided at one apex of the right triangle formed by the frontal supporting base 6, that is, at the apex wherein coverage the two sides 6*b* and 6*c*. When the frontal supporting base 6 approaches plate extension 32 at the right frontal end of frame 10, the hole 6*d* of the supporting base 6 and the hole 32*a* of plate extension 32 are arranged so as to be coaxially aligned, and then a pin 6' which is illustrated in FIG. 4*a* is provided to pass through coaxially aligned holes 6*d* and 32*a* and fixedly connect the frontal supporting base 6 to frame 10, as illustrated in the assembled view of FIG. 4*b*. An additional pin 6' is provided at the other left side of frame 10 to be used for the connection of an identical supporting base 6 to the plate extension 42 provided with a centrally oriented hole 42*a* that again is arranged in coaxial alignment with hole 6*d* of the supporting base 6. In accordance with a preferred embodiment of the invention a ball bearing is provided within each of the aforementioned holes 32*a*, 42*a* of the plate extensions 32, 42, such ball bearing allowing the necessary movement for changing of the inclination of frame 10, such inclination changing being activated by the lifting mechanism described hereinbelow.

Figure 5A:
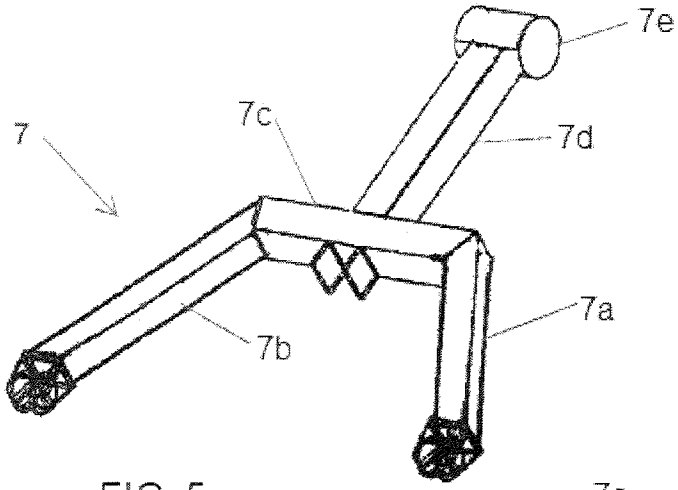
FIGS. 5*a* and 5*b* illustrate respectively a supporting base at the rear side of the frame and a rod of a lift mechanism adapted to provide a capacity of modifying the inclination of the frame.
Figure 5C:
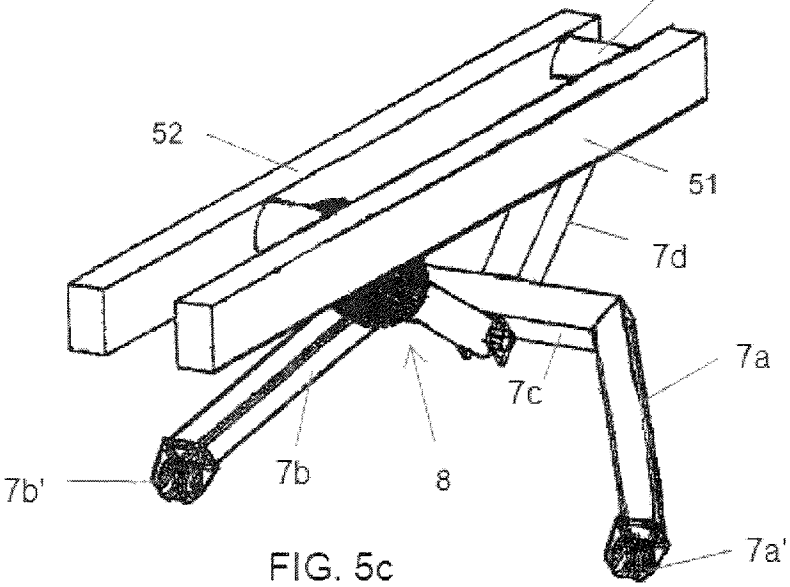
FIGS. 5*c* and 5*d* illustrate respectively in a perspective and in a side view a pair of beams of the rear side of the frame onto which are mounted the supporting base of the frame and the rod of the lift mechanism respectively that are illustrated in FIGS. 5*a* and 5*b*.

As illustrated in FIG. 5*a*, frame 10 rests at the rear side proximally to the area of the legs of the trainee user through the attachment of supporting base 7 in between the pair of beams 51, 52. The supporting base 7 comprises a pair of legs 7*a*, 7*b* which are connected to the ends of a downwardly extending transverse arm 7*c* and end at rubber pads 7*a*', 7*b*' adapted to abut on the floor. As illustrated in FIG. 5*c*, the transverse arm 7*c* is inserted and operates with the capacity to rotate freely within a pair of aligned opposite holes 51*a*, 52*a* close to the beam 5 and is connected to a shaft 7*d* that ends at a transversely extending shaft 7*e*.

Figure 5B:
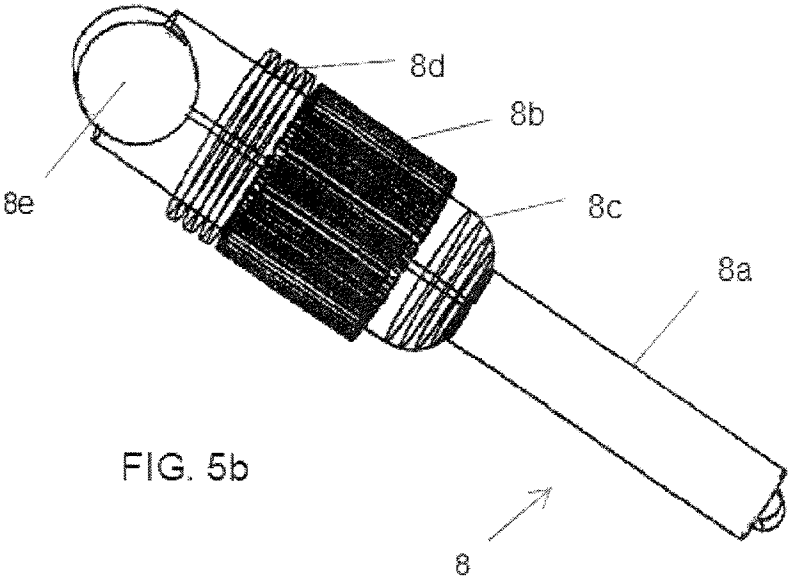
Figure 5D:
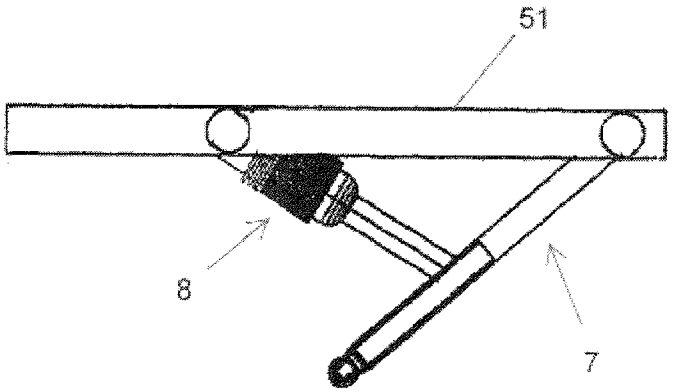

According to a preferred embodiment, the device of the invention is equipped with a lift mechanism 8 which is illustrated in FIG. 5*b* and which comprises an elongate rod portion 8*a* which is connected to the arm 7*c* of the supporting base 7, the elongate rod portion 8*a* extending at a hydraulic cylinder 8*b* that is provided with axially telescopically deployed end portions 8*c*, 8*d*, a transversely extending shaft 8*e* being provided after the telescopically deployed end portion 8*d*, wherein this shaft 8*e* is inserted and operates with the capacity to rotate freely within the aforementioned pair of aligned opposite holes 51*b*, 52*b* close to beam 2 of frame 10. The trainee user has the option to select an upward inclination of frame 10 through a command that is entered and displayed on the monitor and through which the aforementioned telescopically deployed end portions 8*c*, 8*d* extend and increase the length of the lift mechanism 8 thereby providing the desired gradient of frame 10 and an exercise level of increased difficulty. With a reverse command of the trainee user, the telescopically deployed end portions 8*c*, 8*d* are contracted and frame 10 returns to a horizontal position or the frame 10 can even be set to a downward gradient.

According to a preferred embodiment of the invention, the device includes a braking arrangement 70 illustrated in FIGS. 15, 15*a* and 15*b*, which is installed with an angularly configured supporting plate with a first side 71 resting onto the center of the transverse beam 5 and a second side 72 that is perpendicularly oriented to the first side 71 and extends upwardly, parallel to the arrangement of axles 53, 54. A disk 75 is installed at the center of axle 53 and an arcuate pad member 73 is provided along a portion of the circumference thereof, whilst a piston member 74 is mounted onto the abovementioned side 72 of the angularly configured supporting plate 71-72 and extends inwardly so as to abut the circumference of the disk 75 and apply pressure onto the pad member 73 and through the latter onto the axle 53 when the trainee user chooses to activate said braking arrangement 70.

Figure 16:
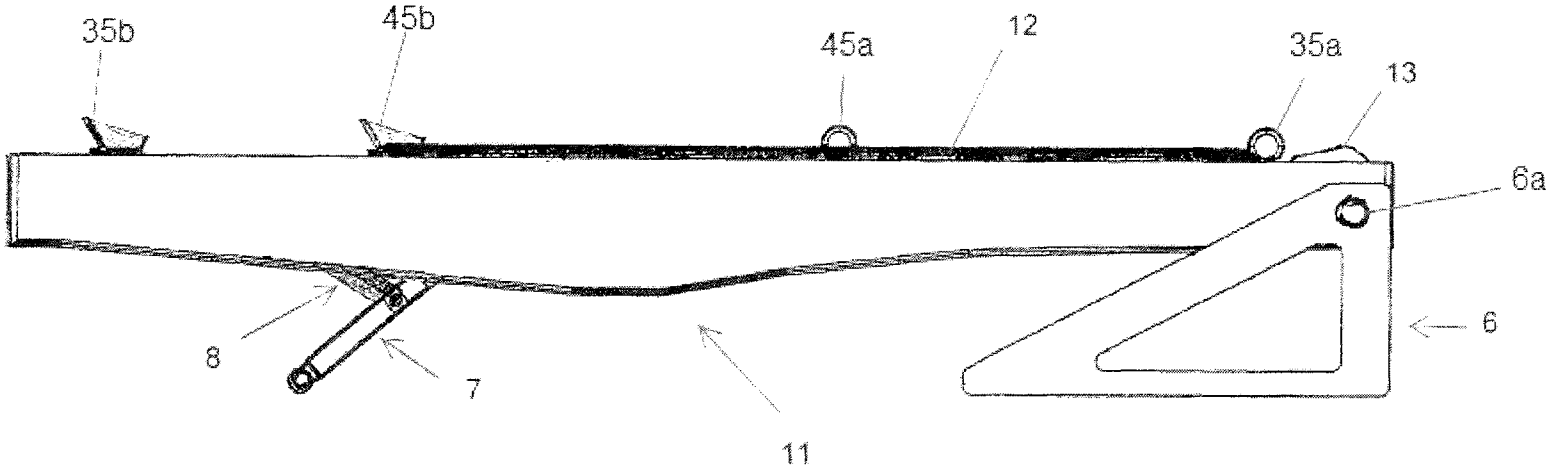
FIG. 16 illustrates a side view of the holistic training device of the invention.
Figure 17A:
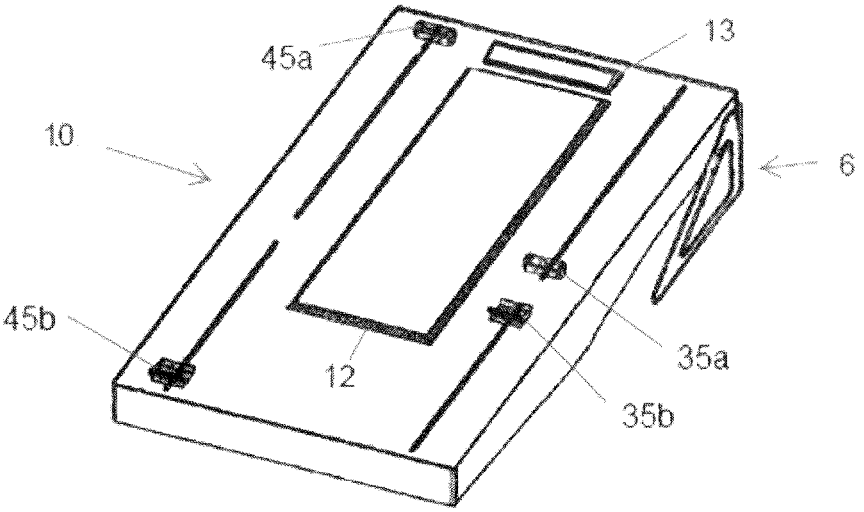
FIGS. 17*a* and 17*c* illustrate the proposed holistic training device respectively in a first position of contraction of the right limbs and extension of the left limbs of the trainee user and in a second position of contraction of the left limbs and extension of right limbs thereof, whilst
Figure 17B:
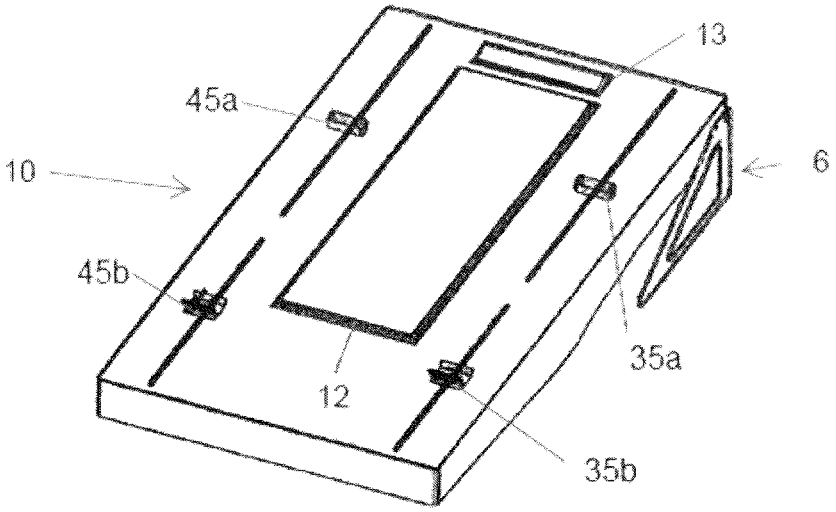
FIG. 17*b* illustrates a position of the proposed device in between the positions of FIGS. 17*a* and 17*c*.
Figure 17C:
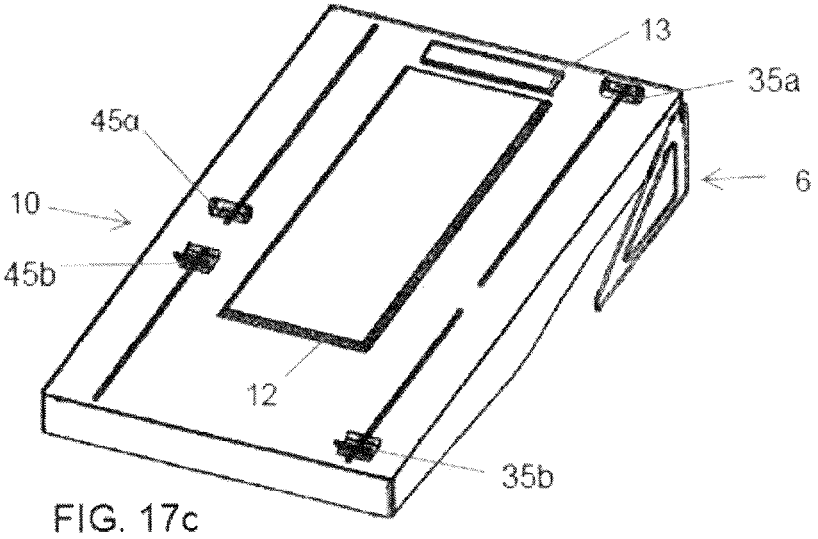

As illustrated in FIG. 8*a*, according to a preferred embodiment of the invention, a covering mat 9 is placed onto frame 10. The covering mat 9 is provided with grooves 9*a*, 9*b*, 9*c*, 9*d* being opened in the longitudinal direction of the longer sides of frame 10, As shown in FIG. 16, the handgrips and foot holds of the trainee user protrude through these aforementioned grooves 9*a*, 9*b*, 9*c*, 9*d* during operation of the device. A pillow member 12 is shown in FIG. 8*b*, such pillow 12 being placed on the top of covering mat 9 when required for a more comfortable contact of the trainee user. A monitor 13 is further provided through which the trainee user can select different modes of operation of the device. By way of example, it is possible to change the inclination of frame 10, and moreover, to monitor the progress of the exercise, for example the number of sequential contractions/extensions of the limbs, the time being spent in exercising. The monitor may also provide a display of dynamically changing parameters relating to the physical condition of the trainee user, such as blood pressure and body pulses thereof. FIG. 8*c* finally illustrates a peripheral side cover 11 that is adapted to cover the perimeter of the frame 10 of the device of the invention. The arrangement of the covering mat 9, pillow 12, perimetrical side cover 11 and monitor 13 is illustrated in FIGS. 1 and 2 that show the successive movements of contraction of the right and left limbs respectively, as well as in FIGS. 17*a* and 17*c* that show, without the trainee user, the respective positions of the handgrips and foot holds of the trainee user, for the phases of the exercise that are illustrated in FIGS. 17*a* and 17*c*. FIG. 17*b* illustrates a further phase of the exercise that takes place intermediately between these extreme positions illustrated in FIGS. 17*a* and 17*c*.

In order to execute the exercises, the trainee user lies face down and after customizing the handgrip and the foot hold items to his needs, he places his hands (his palms in particular) onto the aforementioned handgrip items and his feet (the frontal portion of the soles of the feet incorporating the metatarsal bones in particular) within the aforementioned foot hold items and subsequently raises his body so that his contact with the device is limited only to the contact of the palms onto the handgrips and of the frontal portion of the soles of the feet incorporating the metatarsal bones within the foot holds, whereby the exercising can start with sequential steps of contraction of left limbs and simultaneous extension of right limbs, immediately followed by the reverse step of contraction of right limbs and simultaneous extension of left limbs. During the extreme sequential extension and contraction of right and left limbs (arms and legs), the required bending of knees and elbows of left and right limbs (arms and legs) is performed freely, as, apart from the aforementioned elements of the palm of the hand and of the sole of the foot that are respectively connected to the handgrips and foot holds, the arms and legs of the trainee user are completely free and do not come into contact with any part of the device during the training operation.

In the course of execution of the exercise the trainee user has the aforementioned option to monitor or even change the parameters of the exercise on the screen. The proposed exercise simulates the movement of an alligator, crocodile and lizards in general. It is noted that the trainee user, also following training instructions, can select different sets of exercises, depending on the case, which are not necessarily consistent with the proposed adjustment to their personal height of the handgrips and foot holds on both sides of the device. Thus, they can for example adjust one side of the handgrips and foot holds to their personal height, e.g. in order to follow a stroke of a length of 180 cm and select a smaller height and stroke, e.g. a stroke of a length of 160 cm, at the other side, so that in every cycle of the exercise, through the sequential contraction/extension of the limbs on the left and the right side, one side exercises intensively while the other side remains relatively relaxed. Subsequently they can reverse the settings adjusting the side performing a stroke of 180 cm to a stroke of 160 cm and the side performing a stroke of 160 cm to a stroke of 180 cm. Furthermore, the trainee user can select a very intensive workout of one or both sides of the device and subsequently of the body thereof, through selecting strokes that exceed his personal height.

The invention claimed is:

1. A holistic training device wherein a user executes a training operation of sequential cycles of a first step of synchronized contraction of left limbs and extension of right limbs, followed by a second step of reverse synchronized contraction of right limbs and extension of left limbs thereof, comprising:

a frame (10) with a pair of parallel lateral beams (1, 2) with a first lateral beam (1) of said pair of parallel lateral beams configured to be located proximally to a head of the user and a second lateral beam (2) of said pair of parallel lateral beams configured to be located proximally to feet of the user, a pair of parallel longitudinal beams (3, 4) with a first longitudinal beam (3) of said pair of parallel longitudinal beams configured to be located to a right side of a torso of the user and a second longitudinal beam (4) of said pair of parallel longitudinal beams configured to be located to a left side of the torso of the user, a cross beam (5) extending parallel to and between the first lateral beam and the second lateral beam, a pair of intermediate plate extensions (31, 41) being respectively provided along said pair of parallel longitudinal beams (3, 4) at each longitudinal end of the cross beam (5), a first intermediate plate extension (31) of said pair of intermediate plate extensions (31, 41) provided with a first pair of holes (31*a*, 31*b*) and a second intermediate plate extension (41) of said pair of intermediate plate extensions provided with a second pair of holes (41*a*, 41*b*), and a pair of end plate extensions (32, 42) respectively provided along said pair of parallel longitudinal beams (3, 4) at each longitudinal end of said first lateral beam (1), with a first hole (32*a*) provided in a first end plate extension (32) of the pair of end plate extensions and a second hole (42*a*) provided in a second end plate extension (42) of the pair of end plate extensions;

a pair of axles (53, 54), with a first axle (53) of the pair of axles freely rotatable within a first pair of corresponding holes (31*a*, 41*a*) of the first pair of holes and the second pair of holes and a second axle (54) of the pair of axles freely rotatable within a second pair of corresponding holes (31*b*, 41*b*) of the first pair of holes and the second pair of holes of the pair of intermediate plate extensions (31, 41);

a first pair of axle pulleys (56*a*, 57*a*) fixedly mounted along ends of the first axle (53) and a second pair of axle pulleys (56*b*, 57*b*) fixedly mounted along ends of the second axle (54), and a pair of first end pulleys (16*a*, 17*a*) fixedly mounted to the first lateral beam (1) and a pair of second end pulleys (16*b*, 17*b*) fixedly mounted to the second lateral beam (2);

a pair of right side straps (36*a*, 36*b*) extending close to and parallel to the first longitudinal beam (3) and a pair of left side straps (37*a*, 37*b*) extending close to and parallel to the second longitudinal beam (4) of the frame (10), a first strap (36*a*) of the pair of right side straps and a first strap (37*a*) of the pair of left side straps located between said first lateral beam (1) and said cross beam (5) and a second strap (36*b*) of the pair of right side straps and a second strap (37*b*) of the pair of left side straps located between said second lateral beam (2) and said cross beam (5);

a first pair of rails (33, 34) extending parallel to and close to the first longitudinal beam (3) and a second pair of rails (43, 44) extending parallel to and close to the second longitudinal beam (4) of said frame (10), each rail of said first pair of rails and said second pair of rails having an angular configuration with a horizontally extending portion adapted to receive a platform (60) of a plurality of platforms sliding thereupon and a vertically extending portion underlying and perpendicular to said horizontally extending portion;

each platform (60) of said plurality of platforms being respectively provided for each strap of the pair of right side straps and the pair of left side straps (36*a*, 36*b*, 37*a*, 37*b*), each said platform (60) of the plurality of platforms having a flat surface (61) that extends to a width that corresponds to either a distance between rails (33, 34) of the first pair of rails (33, 34) or to a distance between rails (43, 44) of the second pair of rails (43, 44), said flat surface (61) extending across an underlying centrally located box structure (62) and extending between underlying parallel side walls (63, 64), an upper surface of said box structure (62) being provided with an array of equidistantly spaced holes, an interior surface of each side wall of the parallel side walls (63, 64) being provided with a pair of longitudinally spaced wheels (65) fixedly mounted thereupon, each wheel of said pair of wheels (65) of each side wall of said parallel side walls (63, 64) being respectively adapted to support said platform (60) and allow sliding thereof onto the horizontally extending portion of a first rail (33) or a second rail (34) of said first pair of rails (33, 34) or of a first rail (43) or a second rail (44) of said second pair of rails (43, 44), a wheel (66) provided intermedially between each said pair of wheels (65) of each side wall of said parallel side walls (63, 64), said wheel (66) adapted to abut a bottom surface of the horizontally extending portion of the first rail (33) or the second rail (34) of said first pair of rails (33, 34) or of the horizontally extending portion of the first rail (43) or the second rail (44) of said second pair of rails (43, 44) thereby supporting the platform (60) and averting an upward or a downward displacement thereof;

a pair of handgrip items (35*a*, 45*a*) and a pair of foot hold items (35*b*, 45*b*), each handgrip item (35*a*, 45*a*) of the pair of handgrip items comprising a grip shaft (76) adapted to provide a secure grip in a palm of the user and each foot hold item (35*b*, 45*b*) of said pair of foot hold items comprising a structure (86) adapted to nest a frontal foot sole portion including metatarsal bones of the user, said grip shaft (76) of said each handgrip item (35*a*, 45*a*) extending at a connection shaft (77), and said structure (86) of each said foot hold item (35*b*, 45*b*) extending at a shaft (87), the connection shaft (77) and shaft (87) adapted to provide connection of a corresponding handgrip item or a corresponding foot hold item with a corresponding platform (60) of said plurality of platforms through introduction thereof into a hole (67) of said array of holes (67) of the corresponding platform (60) appropriately associated with a height of the user;

wherein said box structure (62) of each platform (60) of said plurality of platforms is connected with a first end of a corresponding protruding member (40), a second end of said corresponding protruding member (40) connected to a corresponding strap of either said pair of left side straps (37*a*, 37*b*) or said pair of right side straps (36*a*, 36*b*) underlying said corresponding platform (60) whereby movement of said corresponding platform (60) results in movement of equivalent length of said corresponding strap;

wherein the first strap (36*a*) of the pair of right side straps is connected at one end to a lower side of an upper right side axle pulley (56*a*) of the first pair of axle pulleys and at an opposite end to a lower side of a lower right side axle pulley (56*b*) of the second pair of axle pulleys, the first strap (36*a*) of the pair of right side straps further secured around a right side pulley (16*a*) of the pair of first end pulleys, wherein the second strap (36*b*) of the pair of right side straps is connected at one end to an upper side of the upper right side axle pulley (56*a*) of the first pair of axle pulleys and at an opposite end to an upper side of the lower right side axle pulley (56*b*) of the second pair of axle pulleys, the second strap (36*b*) of the pair of right side straps further secured around a right side pulley (16*b*) of the pair of second end pulleys, wherein the first strap (37*a*) of the pair of left side straps is connected at one end to an upper side of an upper left side axle pulley (57*a*) of the first pair of axle pulleys and at an opposite end to an upper side of a lower left side axle pulley (57*b*) of the second pair of axle pulleys, the first strap (37*a*) of the pair of left side straps further secured around a left side pulley (17*a*) of the pair of first end pulleys, wherein the second strap (37*b*) of the pair of left side straps is connected at one end to a lower side of the upper left side axle pulley (57*a*) of the first pair of axle pulleys and at an opposite end to a lower side of the lower left side axle pulley (57*b*) of the second pair of axle pulleys, the second strap (37*b*) of the pair of left side straps further secured around a left side pulley (17*b*) of the pair of second end pulleys, wherein the first strap (36*a*) of the pair of right side straps, the second strap (36*b*) of the pair of right side straps, the first strap (37*a*) of the pair of left side straps, and the second strap (37*b*) of the pair of left side straps are adapted to move following the movement of the corresponding platform (60) during execution of sequential cycles of the first step of synchronized contraction of left limbs and extension of right limbs followed by the second step of reverse synchronized contraction of right limbs and extension of left limbs of the user.

2. The holistic training device according to claim 1, wherein the frame (10) is configured to rest on a flat floor through a pair of frontal supporting bases (6) which are connected at each said longitudinal end of the first lateral beam (1) and through a rear supporting base (7), which extends in the direction of the second lateral beam (2), wherein each frontal supporting base (6) of the pair of frontal supporting bases is configured as a right triangle with a first side (6*a*) resting on the floor, a second side (6*b*) perpendicular to the first side (6*a*) vertically upwardly extending and connected to said frame (10) and a third side (6*c*) of the hypotenuse of said right triangle, a hole (6*d*) being provided at an apex of the right triangle wherein the second side (6*b*) and the third side (6*c*) of the triangle converge, each said frontal supporting base (6) being adapted to respectively approach the pair of end plate extensions (32, 42) at a right and left frontal end of the frame (10), said hole (6*d*) of each respective frontal supporting base (6) the hole (32*a*, 42*a*) of each respective end plate extension (32, 42) being arranged so as to be coaxially aligned, a pin (6') provided to pass through the coaxially aligned holes (6*d*, 32*a*) at one side and through coaxially aligned holes (6*d*, 42*a*) at the other side of the frame (10) for assembly of the pair of frontal supporting base (6) onto the frame (10), and wherein said rear supporting base (7) is attached in between a pair of beams (51, 52) that extend parallel to the pair of longitudinal beams (3, 4), in between said cross beam (5) and said second lateral beam (2) and comprises a pair of legs (7*a*, 7*b*) which are connected to ends of a transversely downwardly extending arm (7*c*), said pair of legs (7*a*, 7*b*) provided with end rubber pads (7*a*', 7*b*') adapted to abut the floor, said transversely downwardly extending arm (7*c*) connected to a shaft (7*d*) that ends at a transversely extending shaft (7*e*), said transversely extending shaft (7*e*) being inserted and operating with the capacity to rotate freely within a pair of coaxially aligned opposite holes (51*a*, 52*a*) of the pair of beams (51, 52) close to said cross beam (5).

3. The holistic training device according to claim 2, further comprising a lift mechanism (8), said lift mechanism (8) comprising an elongate rod portion (8*a*), said rod portion (8*a*) connected to the transversely downwardly extending arm (7*c*) of said rear supporting base (7) and extending at a hydraulic cylinder (8*b*), said hydraulic cylinder (8*b*) provided with axially telescopically deployed portions (8*c*, 8*d*) on either side thereof and a transversely extending shaft (8*e*) adapted to insert and operate, with the capacity to rotate freely, within a pair of coaxially aligned opposite holes (51*b*, 52*b*) on the pair of beams (51, 52) close to the second lateral beam (2) of the frame (10), wherein the lift mechanism is configured to allow the user to select an upward or downward inclination of the frame (10) through extension or contraction of said telescopically deployed portions (8*c*, 8*d*) of the lift mechanism (8) and wherein a ball bearing is provided within each of said holes (32*a*, 42*a*) of the pair of end plate extensions (32, 42), each said ball bearing allowing, as necessary, movement activated by the lift mechanism (8) of the frame (10) for the change of inclination thereof.

4. The holistic training device according to claim 1, wherein the frame (10) is provided with a first pair of springs (14*a*, 15*a*) at an interior part of said first lateral beam (1), a second pair of springs (14*d*, 15*d*) at an interior part of said second lateral beam (2), a third pair of springs (14*b*, 15*b*) at an interior part of the cross beam (5) facing towards said first lateral beam (1), and a fourth pair of springs (14*c*, 15*c*) at an interior part of the cross beam (5) facing towards said second lateral beam (2), wherein each said platform of the plurality of platforms (60) is arranged so that the centrally located box structure (62) thereof extending parallel to the corresponding underlying strap (36*a*, 36*b*, 37*a*, 37*b*) execute a stroke of an identical length when said platform (60) is moved by a corresponding handgrip item (35*a*, 45*a*) or by a corresponding foot hold item (35*b*, 45*b*), said stroke for each handgrip item terminated when said corresponding platform (60) respectively bumps against a right side spring (14*a*) of the first pair of springs or a right side spring (14*b*) of the third pair of springs or against a left side spring (15*a*) of the first pair of springs or a left side spring (15*b*) of the third pair of springs, and said stroke for each foot hold item terminated when said corresponding platform (60) respectively bumps against a right side spring (14*c*) of the fourth pair of springs or a right side spring (14*d*) of the second pair of springs or against a left side spring (15*c*) of the fourth pair of springs or a left side spring (15*d*) of the second pair of springs (15*c*, 15*d*), wherein said bumps provide a capacity of absorption of vibrations and provides a thrust adapted to reverse the movement of each said platform (60) towards an opposite direction.

5. The holistic training device according to claim 1, wherein said frame (10) is configured to rest on a flat floor through said pair of intermediate plate extensions and through said pair of end plate extensions (32, 42).

6. The holistic training device according to claim 1, further comprising a braking arrangement (70) comprising an angularly configured supporting plate with a first side (71) resting onto a center of the cross beam (5) and a second side (72) perpendicularly oriented to the first side (71) and extending upwardly and parallel to the arrangement of the pair of axles (53, 54), a disk (75) being installed at the center of the first axle (53) and an arcuate pad member (73) being provided along a portion of a circumference thereof, a piston member (74) being mounted onto said first side (71) of the angularly configured supporting plate, the piston member (74) extending inwardly from said second side (72) of the angularly configured supporting plate so as to abut the circumference of the disk (75) and apply pressure onto the pad member (73) and through the latter onto the first axle (53) when the user chooses to activate said braking arrangement (70).

7. The holistic training device according to claim 1, wherein the grip shaft (76) and connection shaft (77) of each said handgrip item (35*a*, 45*a*) of said pair of handgrip items comprises a shaft (76*a*) adapted to provide a secure grip of the palm of the user, said shaft (76*a*) attached to a freely rotating shaft (77*a*), a pin (78) adapted to pass through a hole (78*a*) and a ball bearing (79) of said freely rotating shaft (77*a*) and a hole (78*b*) of the shaft (76*a*), and wherein the structure (86) and shaft (87) of each said foot hold item (35*b*, 45*b*) of said pair of foot hold items comprises an open inclined surface (86*a*), a protruding member with a hole (88*b*) being employed to connect a sole portion of the user by means of a connecting pin (88), said connecting pin (88) having previously passed through a ball bearing (89) mounted at a frontal portion (89*a*) of footwear of the user, each said foot hold item extending at an underlying shaft (87*a*), wherein said freely rotating shaft (77*a*) of each said handgrip item (35*a*, 45*a*) and said shaft (87*a*) of each said foot hold item (35*b*, 45*b*) are of the same caliber with each said hole of the array of holes (67) provided onto each said platform (60) of the plurality of platforms and are adapted to be inserted to selected holes of the array of holes (67) that correspond to the height of the user, wherein each said handgrip item (35*a*, 45*a*) is configured to rotate freely around the ball bearing (79) of said freely rotating shaft (77*a*) and each said foot hold item (35*b*, 45*b*) is configured to rotate freely around the ball bearing (89) thereby providing increased training and strengthening of muscles and tendons of the palm of the hand and of a sole of a foot of the user.

8. The holistic training device according to claim 1, further comprising a covering mat (9) of said frame (10), said covering mat (9) being provided with grooves (9*a*, 9*b*, 9*c*, 9*d*), said pair of handgrip items (35*a*, 45*a*) and said pair of foot hold items (35*b*, 45*b*) adapted to protrude through a corresponding groove of said grooves (9*a*, 9*b*, 9*c*, 9*d*), a pillow (12) provided on top of said covering mat (9), and a monitor (13) through which the user is capable of monitoring progress of exercise and select different modes of operation of the device.

* * * * *